US012139821B2

(12) United States Patent
Liu et al.

(10) Patent No.: US 12,139,821 B2
(45) Date of Patent: Nov. 12, 2024

(54) FOCUSED ROTARY JET SPINNING DEVICES AND METHODS OF USE THEREOF

(71) Applicant: President and Fellows of Harvard College, Cambridge, MA (US)

(72) Inventors: Qihan Liu, Cambridge, MA (US); Kevin Kit Parker, Cambridge, MA (US); Huibin Chang, Cambridge, MA (US)

(73) Assignee: President and Fellows of Harvard College, Cambridge, MA (US)

( * ) Notice: Subject to any disclaimer, the term of this patent is extended or adjusted under 35 U.S.C. 154(b) by 478 days.

(21) Appl. No.: 17/421,047

(22) PCT Filed: Jan. 14, 2020

(86) PCT No.: PCT/US2020/013466
§ 371 (c)(1),
(2) Date: Jul. 7, 2021

(87) PCT Pub. No.: WO2020/150207
PCT Pub. Date: Jul. 23, 2020

(65) Prior Publication Data

US 2022/0090300 A1 Mar. 24, 2022

Related U.S. Application Data

(60) Provisional application No. 62/792,036, filed on Jan. 14, 2019.

(51) Int. Cl.
*D01D 5/14* (2006.01)
*D01D 5/18* (2006.01)

(52) U.S. Cl.
CPC ..... *D01D 5/14* (2013.01); *D01D 5/18* (2013.01)

(58) Field of Classification Search
CPC ..... D01D 5/14; D01D 5/15
See application file for complete search history.

(56) References Cited

U.S. PATENT DOCUMENTS 1,500,934 A 7/1924 Hooper
1,975,504 A 10/1934 Formhals
(Continued)

FOREIGN PATENT DOCUMENTS

CN 1710160 A 12/2005
CN 101538745 A 9/2009
(Continued)

OTHER PUBLICATIONS

Google translation of JP 2013053398A (Year: 2023).*
(Continued)

*Primary Examiner* — Emmanuel S Luk
(74) *Attorney, Agent, or Firm* — McCarter & English, LLP; Maria Laccotripe Zacharakis; Anita M. Bowles

(57) ABSTRACT

Systems and methods for focused direction deposition of a micron or nanometer dimension polymeric fiber and materials of such fibers are described herein. Systems and methods employ one or more gas flows to entrain and deflect fibers produced by a rotary jet spinning system forming a focused fiber stream. Some embodiments enable control of alignment and distribution of the fibers with a relatively high fiber throughput.

19 Claims, 16 Drawing Sheets

(56) References Cited

U.S. PATENT DOCUMENTS

| | | | |
|---|---|---|---|
| 2,067,410 | A | 1/1937 | Newnham |
| 2,138,394 | A | 11/1938 | Wuppermann |
| 2,336,743 | A | 12/1943 | Lozano et al. |
| 2,988,469 | A | 6/1961 | Watson |
| 3,038,779 | A | 6/1962 | Georg et al. |
| 3,441,473 | A | 4/1969 | Brundige |
| 4,237,081 | A | 12/1980 | Murphy et al. |
| 4,345,355 | A | 8/1982 | Berchoux et al. |
| 4,374,978 | A | 2/1983 | Fujiwara et al. |
| 4,536,361 | A | 8/1985 | Torobin |
| 4,702,876 | A | 10/1987 | Ebregt et al. |
| 4,832,723 | A | 5/1989 | Shisler et al. |
| 5,015,278 | A | 5/1991 | Lee |
| 5,066,430 | A | 11/1991 | Matthews |
| 5,114,631 | A | 5/1992 | Nyssen et al. |
| 5,246,776 | A | 9/1993 | Meraldi et al. |
| 5,441,754 | A | 8/1995 | Evans, Sr. |
| 5,447,423 | A | 9/1995 | Fuisz et al. |
| 5,494,616 | A | 2/1996 | Voelker et al. |
| 5,523,031 | A | 6/1996 | Ault et al. |
| 6,113,818 | A | 9/2000 | Pellegrin et al. |
| 6,159,597 | A | 12/2000 | Meerman et al. |
| 6,207,274 | B1 | 3/2001 | Ferenc et al. |
| 6,382,526 | B1 | 5/2002 | Reneker et al. |
| 6,596,048 | B1 | 7/2003 | Tuffal et al. |
| 8,080,197 | B2 | 12/2011 | Meerman et al. |
| 8,192,981 | B2 | 6/2012 | Hoerstrup et al. |
| 8,399,243 | B2 | 3/2013 | Bouten et al. |
| 8,617,237 | B2 | 12/2013 | Hoerstrup et al. |
| 8,636,793 | B2 | 1/2014 | Hoerstrup et al. |
| 9,410,267 | B2 | 8/2016 | Parker et al. |
| 9,669,141 | B2 | 6/2017 | Parker et al. |
| 9,738,046 | B2 | 8/2017 | Parker et al. |
| 10,519,569 | B2 | 12/2019 | Parker et al. |
| 11,174,571 | B2 | 11/2021 | Parker et al. |
| 2002/0148050 | A1 | 10/2002 | Luo et al. |
| 2002/0182241 | A1 | 12/2002 | Borenstein et al. |
| 2003/0147983 | A1 | 8/2003 | Berrigan et al. |
| 2003/0187500 | A1 | 10/2003 | Jansen et al. |
| 2003/0199083 | A1 | 10/2003 | Vilendrer et al. |
| 2004/0034408 | A1 | 2/2004 | Majercak et al. |
| 2004/0037813 | A1 | 2/2004 | Simpson et al. |
| 2004/0093080 | A1 | 5/2004 | Helmus et al. |
| 2004/0234571 | A1 | 11/2004 | Jang |
| 2005/0043209 | A1 | 2/2005 | Schmiedel et al. |
| 2005/0136253 | A1 | 6/2005 | Michael et al. |
| 2005/0143810 | A1 | 6/2005 | Dauner et al. |
| 2005/0163932 | A1 | 7/2005 | Zschieschang et al. |
| 2005/0209687 | A1 | 9/2005 | Sitzmann et al. |
| 2005/0240262 | A1 | 10/2005 | White |
| 2006/0060999 | A1 | 3/2006 | Amagasa et al. |
| 2006/0094096 | A1 | 5/2006 | Wang et al. |
| 2006/0105275 | A1 | 5/2006 | Maloney et al. |
| 2006/0228435 | A1 | 10/2006 | Andrady et al. |
| 2006/0246584 | A1 | 11/2006 | Covelli |
| 2007/0087178 | A1 | 4/2007 | Hendriks et al. |
| 2007/0207186 | A1 | 9/2007 | Scanlon et al. |
| 2008/0023888 | A1 | 1/2008 | Brang et al. |
| 2008/0038352 | A1 | 2/2008 | Simpson et al. |
| 2008/0131965 | A1 | 6/2008 | Baaijens |
| 2008/0136054 | A1 | 6/2008 | Fabbricante et al. |
| 2008/0145596 | A1 | 6/2008 | Levit et al. |
| 2008/0211121 | A1 | 9/2008 | Lai et al. |
| 2008/0237934 | A1 | 10/2008 | Reneker et al. |
| 2008/0242171 | A1 | 10/2008 | Huang et al. |
| 2008/0281434 | A1 | 11/2008 | Schmidt et al. |
| 2008/0299160 | A1 | 12/2008 | Agboh et al. |
| 2008/0307766 | A1 | 12/2008 | Petras et al. |
| 2009/0093318 | A1 | 4/2009 | Piontek |
| 2009/0209982 | A1 | 8/2009 | Hoerstrup et al. |
| 2009/0232874 | A1 | 9/2009 | Chu et al. |
| 2009/0232920 | A1 | 9/2009 | Lozano et al. |
| 2009/0233361 | A1 | 9/2009 | Farhat et al. |
| 2009/0269429 | A1 | 10/2009 | Lozano et al. |
| 2009/0280207 | A1 | 11/2009 | Lozano et al. |
| 2009/0280325 | A1 | 11/2009 | Lozano et al. |
| 2010/0028999 | A1 | 2/2010 | Nain |
| 2010/0037576 | A1 | 2/2010 | Claasen et al. |
| 2010/0233928 | A1 | 9/2010 | Ferry et al. |
| 2011/0073243 | A1 | 3/2011 | Yu et al. |
| 2011/0263729 | A1 | 10/2011 | Hermanutz et al. |
| 2012/0135448 | A1 | 5/2012 | Parker et al. |
| 2013/0217128 | A1 | 8/2013 | Bouten et al. |
| 2013/0312638 | A1 | 11/2013 | Parker et al. |
| 2013/0344531 | A1 | 12/2013 | Akra et al. |
| 2014/0005772 | A1 | 1/2014 | Edelman et al. |
| 2014/0023703 | A1 | 1/2014 | Fernandez et al. |
| 2014/0090141 | A1 | 4/2014 | Friedrich |
| 2014/0272318 | A1 | 9/2014 | Lawrence et al. |
| 2015/0182679 | A1 | 7/2015 | Parker et al. |
| 2015/0354094 | A1 | 12/2015 | Parker et al. |
| 2016/0145771 | A1* | 5/2016 | Kim ..... D01D 5/18 425/8 |
| 2016/0168756 | A1* | 6/2016 | Gladish ..... D04H 3/03 428/221 |
| 2016/0220361 | A1 | 8/2016 | Weber et al. |
| 2016/0235527 | A1 | 8/2016 | Sanders et al. |
| 2016/0331528 | A1 | 11/2016 | Parker et al. |
| 2017/0121853 | A1* | 5/2017 | She ..... D01D 5/0061 |
| 2017/0175325 | A1 | 6/2017 | Milton et al. |
| 2017/0306148 | A1* | 10/2017 | Bansal ..... D01D 5/42 |
| 2017/0360551 | A1 | 12/2017 | Liu |
| 2019/0308390 | A1* | 10/2019 | Bansal ..... B32B 37/24 |
| 2019/0343190 | A1 | 11/2019 | Ogunbiyi et al. |
| 2020/0123680 | A1* | 4/2020 | Padron ..... A43B 1/00 |
| 2020/0376170 | A1 | 12/2020 | Ahn et al. |
| 2021/0205076 | A1 | 7/2021 | Parker et al. |
| 2021/0371790 | A1 | 12/2021 | MacQueen et al. |
| 2022/0090300 | A1 | 3/2022 | Liu et al. |
| 2022/0136136 | A1 | 5/2022 | Parker et al. |
| 2022/0380943 | A1 | 12/2022 | Gonzalez et al. |

FOREIGN PATENT DOCUMENTS

| | | | | |
|---|---|---|---|---|
| CN | 101824382 | A | | 9/2010 |
| CN | 101871133 | A | | 10/2010 |
| CN | 102071542 | A | | 5/2011 |
| CN | 203360644 | U | * | 12/2013 |
| CN | 103805511 | A | | 5/2014 |
| CN | 103998667 | A | | 8/2014 |
| CN | 105121716 | A | | 12/2015 |
| CN | 105142652 | A | | 12/2015 |
| CN | 108842195 | A | * | 11/2018 |
| DE | 1170578 | B | | 5/1964 |
| EP | 1077072 | A2 | | 2/2001 |
| EP | 1499366 | B1 | | 7/2007 |
| EP | 1858450 | A1 | | 11/2007 |
| EP | 1968660 | B1 | | 11/2010 |
| EP | 2267114 | A2 | | 12/2010 |
| EP | 1663332 | B1 | | 1/2011 |
| EP | 1957632 | B1 | | 5/2012 |
| EP | 2617389 | A1 | | 7/2013 |
| EP | 2117476 | B1 | | 1/2014 |
| EP | 2117477 | B1 | | 4/2014 |
| EP | 1974009 | B1 | | 9/2015 |
| EP | 2997935 | A1 | | 3/2016 |
| EP | 3049025 | A1 | | 8/2016 |
| EP | 3049026 | A1 | | 8/2016 |
| IL | 62097 | A | | 7/1985 |
| IL | 62097 | A1 | * | 7/1985 |
| IT | 1135500 | B | * | 8/1986 ..... D01D 5/088 |
| JP | 37-27408 | | | 10/1962 |
| JP | 57-139507 | A | | 8/1982 |
| JP | 62-104908 | A | | 5/1987 |
| JP | 2-74603 | | | 3/1990 |
| JP | 4-228667 | | | 8/1992 |
| JP | 2006-311887 | A | | 11/2006 |
| JP | 2010-031434 | A | | 2/2010 |
| JP | 2013-53398 | A | | 3/2013 |
| JP | 2013053398 | A | * | 3/2013 |
| KR | 92-8999 | B1 | | 10/1992 |
| KR | 10-2006-0010102 | A | | 2/2006 |
| KR | 10-2011-0121924 | A | | 11/2011 |
| KR | 101104336 | B1 | | 1/2012 |

(56) References Cited

FOREIGN PATENT DOCUMENTS

| | | | | |
|---|---|---|---|---|
| NL | 8100664 | A * | 9/1982 | ..... D01D 5/088 |
| NL | 1008349 | C2 | 8/1999 | |
| WO | WO-2003/099230 | A2 | 12/2003 | |
| WO | WO-2004/032713 | A2 | 4/2004 | |
| WO | WO-2004/060426 | A1 | 7/2004 | |
| WO | WO-2004/080681 | A1 | 9/2004 | |
| WO | WO-2005/017226 | A1 | 2/2005 | |
| WO | WO-2010/041944 | A1 | 4/2010 | |
| WO | WO-2010/132636 | A1 | 11/2010 | |
| WO | WO-2012/068402 | A2 | 5/2012 | |
| WO | WO-2013/018021 | A1 | 2/2013 | |
| WO | WO-2015/112839 | A1 | 7/2015 | |
| WO | WO-2015/184273 | A1 | 12/2015 | |
| WO | WO-2016/007879 | A1 | 1/2016 | |
| WO | WO-2016/036532 | A1 | 3/2016 | |
| WO | WO-2017/083381 | A1 | 5/2017 | |
| WO | WO-2018/064393 | A1 | 4/2018 | |
| WO | WO-2019/108712 | A1 | 6/2019 | |
| WO | WO-2019/156941 | A1 | 8/2019 | |
| WO | WO-2020/150207 | A1 | 7/2020 | |
| WO | WO-2021/087371 | A1 | 5/2021 | |

OTHER PUBLICATIONS

Google translation of CN203360644U (Year: 2023).*
Google translation of CN108842195A (Year: 2023).*
U.S. Appl. No. 13/320,031, filed May 13, 2009, U.S. Pat. No. 9,410,267, Issued.
U.S. Appl. No. 15/203,924, filed Jul. 7, 2016, Abandoned.
U.S. Appl. No. 13/988,088, filed Aug. 5, 2013, 2013-0312638, Abandoned.
U.S. Appl. No. 14/359,005, filed May 16, 2014, U.S. Pat. No. 9,738,046, Issued.
U.S. Appl. No. 14/763,620, filed Jul. 27, 2015, U.S. Pat. No. 10,519,569, Issued.
U.S. Appl. No. 16/679,578, filed Nov. 11, 2019, U.S. Pat. No. 11,174,571, Issued.
U.S. Appl. No. 17/501,005, filed Oct. 14, 2021, 2022-0136136, Allowed.
U.S. Appl. No. 15/112,528, filed Jul. 19, 2016, 2016-0331528, Abandoned.
U.S. Appl. No. 17/102,495, filed Nov. 24, 2020, 2021-0205076, Abandoned.
U.S. Appl. No. 16/337,454, filed Mar. 28, 2019, 2019-0343190, Abandoned.
U.S. Appl. No. 16/762,384, filed May 7, 2020, 2020-0376170, Abandoned.
U.S. Appl. No. 16/968,178, filed Aug. 7, 2020, 2021-0371790, Published.
U.S. Appl. No. 17/771,530, filed Apr. 25, 2022, 2022-0380943, Published.
Ahmad et al., Effect of 1-ethyl-3-(3-dimethylaminopropyl) carbodiimide and N-hydroxysuccinimide concentrations on the mechanical and biological characteristics of cross-linked collagen fibres for tendon repair. Regen Biomater. Jun. 2015;2(2):77-85.
Alford et al., Biohybrid thin films for measuring contractility in engineered cardiovascular muscle. Biomaterials. May 2010;31(13):3613-21.
Arumuganathar et al., Living scaffolds (specialized and unspecialized) for regenerative and therapeutic medicine. Biomacromolecules. Mar. 2008;9(3):759-66.
Badrossamay et al., Nanofiber assembly by rotary jet-spinning. Nano Lett. Jun. 9, 2010;10(6):2257-61.
Baker et al., The Mechanical Properties of Dry, Electrospun Fibrinogen Fibers. Mater Sci Eng C Mater Biol Appl. Mar. 1, 2012;32(2):215-221.
Bansal, Water-Based Polymeric Nanostructures for Agricultural Applications. Dissertation zur Erlangung des Doktorgrades der Naturwissenschaften, dem Fachbereich Chemie der Philipps-Universitat Marburg. 183 pages, (2010).
Bansal et al., Water-stable all-biodegradable microparticles in nanofibers by electrospinning of aqueous dispersions for biotechnical plant protection. Biomacromolecules. Feb. 13, 2012;13(2):439-44.
Bauer et al., A Novel Cross-Linked Hyaluronic Acid Porous Scaffold for Cartilage Repair: An In Vitro Study With Osteoarthritic Chondrocytes. Cartilage. Jul. 2016;7(3):265-73.
Bhowmick, Fabrication and Evaluation of Polymeric Hybrid Scaffolds for Skin Tissue Engineering. Submitted in fulfilment of the requirements of the degree of Doctor of Philosophy to the Indian Institute of Technology Delhi. 33 pages, Apr. 2017.
Da et al., Progress in development of bioderived materials for dermal wound healing. Regen Biomater. Oct. 2017;4(5):325-334.
Feinberg et al., Muscular thin films for building actuators and powering devices. Science. Sep. 7, 2007;317(5843):1366-70.
Gallos et al., Lignocellulosic Fibers: A Critical Review of the Extrusion Process for Enhancement of the Properties of Natural Fiber Composites. RSC Adv. 2017;7:34638-34654.
Ghayempour et al., Micro/nanoencapsulation of essential oils and fragrances: Focus on perfumed, antimicrobial, mosquito-repellent and medical textiles. J Microencapsul. Sep. 2016;33(6):497-510.
Guggolz et al., Detection of Daidzein, Formononetin, Genistein, and Biochanin A in Forages. Agricultural and Food Chemistry. 1961;9(4):330-332.
Harfenist et al., Direct Drawing of Suspended Filamentary Micro- and Nanostructures from Liquid Polymers. Nano Letters, 2004;4(10):1931-1937.
Hong et al., Fabrication of electrospun polycaprolactone biocomposites reinforced with chitosan for the proliferation of mesenchymal stem cells. Carbohydrate Polymers. 2011;83:940-946.
Kanis et al., Cellulose acetate butyrate/poly(caprolactonetriol) blends: Miscibility, mechanical properties, and in vivo inflammatory response. J Biomater Appl. Nov. 2014;29(5):654-61. Pre-publication edition.
Kolk, Mathematical Models for a Rotor Spinning Process, Interim Report. TUDelft, Teijintwaron. 57 pages, May 2005.
Lam et al., Design of cell-matrix interactions in hyaluronic acid hydrogel scaffolds. Acta Biomater. Apr. 2014;10(4):1571-1580.
Li et al., Electrospinning of nanofibers: Reinventing the wheel? Adv Mater. Jul. 19, 2004;16(14):1151-1170.
MacQueen et al., A tissue-engineered scale model of the heart ventricle. Nat Biomed Eng. Dec. 2018;2(12):930-941.
Madurantakam et al., Multiple factor interactions in biomimetic mineralization of electrospun scaffolds. Biomaterials. Oct. 2009;30(29):5456-64.
Madurantakam et al., Science of nanofibrous scaffold fabrication: strategies for next generation tissue-engineering scaffolds. Nanomedicine (Lond). Feb. 2009;4(2):193-206.
Nisbet et al., Review paper: a review of the cellular response on electrospun nanofibers for tissue engineering. J Biomater Appl. Jul. 2009;24(1):7-29.
Pabba et al., Biopolymerization-driven self-assembly of nanofiber air-bridges. Soft Matter. 2009;5:1378-1385.
Sarier et al., Organic phase change materials and their textile applications: An overview. Thermochimica Acta. Jul. 20, 2012;540:7-60.
Teeka et al., Preparation of Poly (methyl methacrylate) microcapsule with encapsulated Jasmine oil. Energy Procedia. 2014;56:181-186.
Van Lieshout et al., Electrospinning versus knitting: two scaffolds for tissue engineering of the aortic valve. J Biomater Sci Polym Ed. 2006;17(1-2):77-89.
Weitz et al., Polymer nanofibers via nozzle-free centrifugal spinning. Nano Lett. Apr. 2008;8(4):1187-91.
Xie et al., Putting Electrospun Nanofibers to Work for Biomedical Research. Macromol Rapid Commun. Nov. 19, 2008;29(22):1775-1792.
European Office Action for Application No. 12867106.2, dated Sep. 25, 2015, 9 pages.
International Search Report and Written Opinion for Application No. PCT/US2016/061129, dated Apr. 14, 2017, 7 pages.
International Search Report and Written Opinion for Application No. PCT/US2019/016572, dated Apr. 15, 2019, 15 pages.
International Search Report and Written Opinion for Application No. PCT/US2020/013466, dated Apr. 6, 2020, 10 pages.

(56) References Cited

OTHER PUBLICATIONS

International Search Report and Written Opinion for Application No. PCT/US2020/058379, dated Mar. 10, 2021, 10 pages.
International Search Report and Written Opinion for Application No. PCT/US2010/034662, dated Jul. 9, 2010, 20 pages.
International Search Report and Written Opinion for Application No. PCT/US2011/061241, dated Apr. 11, 2012, 17 pages.
International Search Report and Written Opinion for Application No. PCT/US2014/016197, dated Jul. 30, 2014, 17 pages.
International Search Report and Written Opinion for Application No. PCT/US2012/065646, dated Aug. 27, 2013, 20 pages.
International Search Report and Written Opinion for Application No. PCT/US2017/054125, dated Jan. 9, 2018, 38 pages.
International Search Report and Written Opinion for Application No. PCT/US2018/059722, dated Jan. 30, 2019, 25 pages.
Supplementary European Search Report for Application No. 19750902.9, dated Oct. 8, 2021, 7 pages.
Japanese Office Action for Application No. 2021-540413, dated Jan. 30, 2024, 12 pages.

* cited by examiner

COMSOL v2-f turbulence model simulation

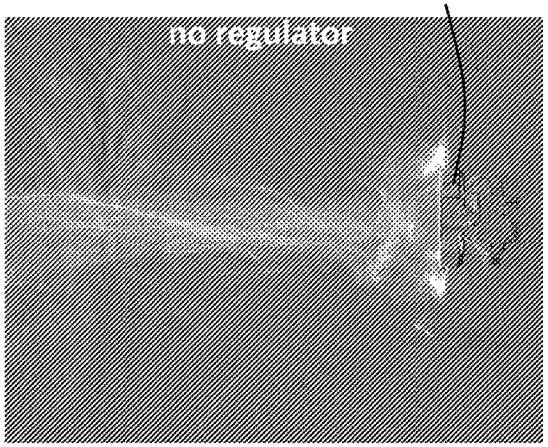
Fig. 6A
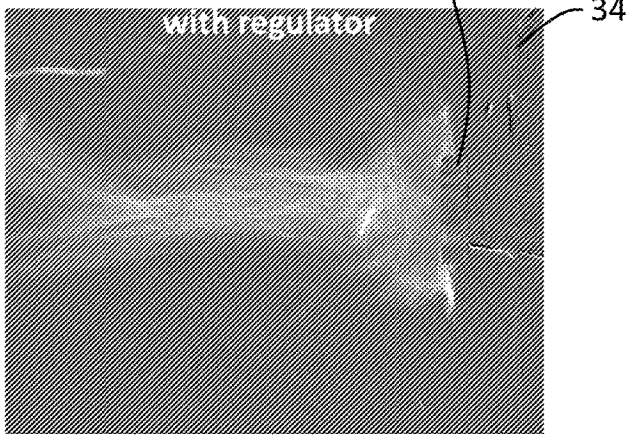
Fig. 7A
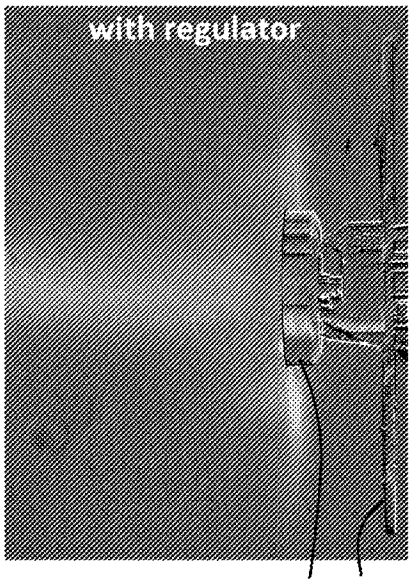
Fig. 6C
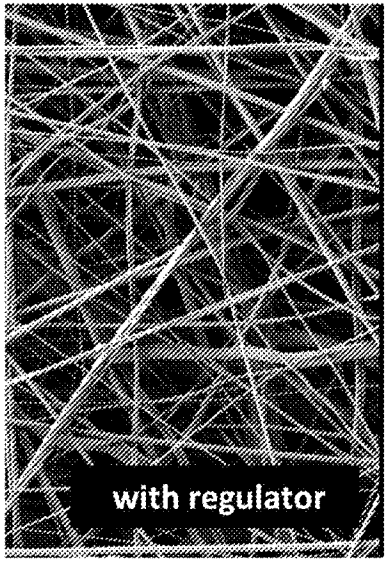
Fig. 7C
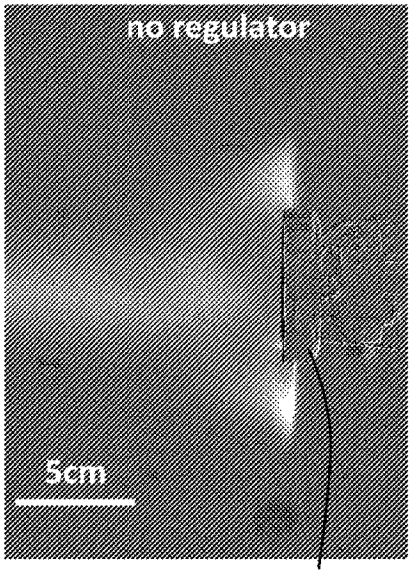
Fig. 6B
Fig. 7B 1/800s exposure, 1/60s difference, maximum intensity overlay 3600 frames Slow spinning = large helical angle

1000 RPM

Collected on 1cm diameter cylinder
30 incidence angle

Optical profilometry

FFT of profilometry

Axis of Cylinder

Fast spinning = small helical angle 10,000 RPM

FOCUSED ROTARY JET SPINNING DEVICES AND METHODS OF USE THEREOF

RELATED APPLICATIONS

This application is a 35 U.S.C. § 371 national stage filing of International Application No. PCT/US2020/013466, filed on Jan. 14, 2020, which claims benefit of and priority to U.S. Provisional Application No. 62/792,036, filed on Jan. 14, 2019. The entire content of each of the aforementioned applications is incorporated by reference herein in its entirety.

GOVERNMENT SUPPORT

This invention was made with government support under DMR-2011754 awarded by the National Science Foundation and under TR003279 awarded by the National Institutes of Health. The government has certain rights in the invention.

TECHNICAL FIELD

Embodiments of the disclosure relate to a directional rotary jet spinning system to manipulate motion of a fiber using air flow convergence.

BACKGROUND OF THE INVENTION

Fibrous structures are used by nature and engineers for a plethora of functions: fiber reinforcement, filtration, thermal insulation, actuation control, etc. The realization of these functions critically relies on both the diameter and the 3D organization of the fibers. Many biological tissues consist of small diameter fibers (e.g., micron-scale or nano-scale diameter fibers) arranged in a complex three-dimensional alignment. For example, muscle fibers that control the motion of the human body are about 10 μm to about 100 μm in diameter and are bundles into fascicles along the direction of actuation. As another example, collagen fibrils, a major component of the extracellular matrix, are about 10 nm to about 100 nm in diameter and are organized into a vast variety of structures for the different mechanical properties of different tissue. While human beings have a fruitful history of engineering thick fibrous structures with diameters of about 100 μm and above, it remains challenging to engineer fine fibrous structures with diameters of about 10 μm and below with control over fiber alignment and organization with conventional technologies. One of the challenges lies in the simultaneous realization of fine fiber diameter, complex three-dimensional (3D) structure, and high-throughput, as illustrated by the comparison of two major fiber manufacturing techniques, random fiber deposition (Random-FD) and extrusion 3D printing (Extrusion-3DP), as shown in FIGS. 1A-1C. In random-FD techniques, such as, for example, melt blowing and electrospinning, fibers approach the target in a randomly arranged cloud and can exhibit poor control over fiber alignment and 3D geometry. Neither the spatial distribution nor the fiber orientation inside the cloud is regulated. Poor control over the fiber cloud leads to poor control over deposition. In contrast, extrusion-3DP extrudes fibers through a moving nozzle that precisely controls the location of deposition and alignment of each portion of the fiber. However, extrusion-3DP has low throughput. While both techniques are capable of producing fibers over a large range of diameters, only extrusion-3DP can produce complex 3D structure, yet random-FD holds orders-of-magnitude advantage in throughput for fine fibers. The limit in throughput is intrinsic: to fill up the same volume, the length of the fiber required increases rapidly as the fiber diameter decreases. Extrusion 3DP has to trace the length of the fiber (e.g., >100 km in length for some applications), while fiber deposition does not.

Accordingly, there is a need in the art for improved systems that enable production of complex 3D structure of small diameter fibers (e.g., fibers having diameters of less than 10 microns) with a high throughput.

SUMMARY OF THE INVENTION

Some embodiments of the present invention include a rotary jet spinning system configured to manipulate the fiber motion through externally imposed gas (e.g., air flow) to form a directional stream of fibers. Some embodiments enable control of fiber alignment and have relatively high throughput.

Some embodiments provide a system for focused directional deposition of one or more micron or nanometer dimension polymeric fibers. The system includes a reservoir configured to hold a material including a polymer and rotatable about a rotation axis. The reservoir includes a first end; a second end opposite the first end; an outer sidewall extending from the first end to the second end, a shape of the reservoir including one or more apertures disposed radially inward from the outer sidewall of the reservoir that are configured to enable a gas to move through the reservoir from the first end to the second end; and one or more orifices formed in the outer sidewall, each of the one or more orifices configured for ejection of the material radially outward through the orifice as an ejected jet during rotation of the reservoir. The system also includes one or more gas flow sources, each configured to direct a flow of gas from upstream of the first end of the reservoir through the one or more apertures of the reservoir from the first end to the second end of the reservoir and downstream of the second end of the reservoir during rotation of the reservoir the one or more gas flow sources collectively forming a combined gas flow in a first direction downstream of the second end of the reservoir that entrains and deflects the one or more ejected jets to form a focused stream of the one or more micron or nanometer dimension polymeric fibers in a first direction, the first direction having an orientation that is within 5 degrees of the rotation axis of the reservoir.

In some embodiments, the one or more gas flow sources comprise a plurality of gas flow sources having a converging orientation to form the combined gas flow in the first direction. In some embodiments, a gas flow rate of at least some of the plurality of gas flow sources relative to others of the gas flow sources is controllable to achieve a balanced combined gas flow. In some embodiments, a number of the plurality of gas flow sources and an arrangement of the plurality of gas flow sources are configured such that, at any single point in time during rotation of the reservoir, gas flow from all of the plurality of gas flow sources flows through an aperture of the one or more apertures of the reservoir or the gas flow from all of the plurality of gas flow sources is blocked by the reservoir. In some embodiments, the plurality of gas flow sources comprises three gas flow sources.

In some embodiments, a total gas flow rate from the one or more gas flow sources is controllable to change a distance from the reservoir at which the stream of the micron or nanometer dimension polymeric fiber has the tightest focus.

In some embodiments the first direction is within 2 degrees of the axis of rotation. In some embodiments, the first direction is substantially parallel to the axis of rotation.

In some embodiments, the focused stream of the one or more micron or nanometer dimension polymeric fibers has a stream width smaller than a diameter of the outer sidewall of the reservoir.

In some embodiments, the system further comprises a flow blocking structure disposed upstream of the plurality of gas flow sources and configured to reduce an effect of airflow upstream of the plurality of gas flow sources on focusing of the stream of the micron or nanometer dimension polymeric fiber. In some embodiments, the flow blocking structure is disposed upstream of the rotating reservoir and configured to at least partially block airflow from upstream of the rotating reservoir reducing an effect of airflow from upstream of the rotating reservoir on an interaction between airflow due to rotation of the reservoir and the flow of gas through the one or more apertures. In some embodiments, the flow blocking structure is stationary and does not rotate with the reservoir. In some embodiments, the flow blocking structure enables enhanced control of a structure of vortices generated by the flow of gas and the rotation of the reservoir thereby improving control of a lateral area of deposition of the micron or nanometer dimension polymeric fiber as the fiber travels toward a target.

In some embodiments, the one or more gas flow sources are configured to enable control of a rate of flow of the gas to focus a lateral area of deposition of the micron or nanometer dimension polymeric fiber as the fiber travels toward a target.

In some embodiments, the system further comprises a target rotation system configured to rotate a three dimensional target during deposition to deposit the fiber on more than one side of the target.

In some embodiments, the system is configured to be hand held.

In some embodiments, the system further comprises a coagulation, precipitation or cross-linking reservoir configured to hold a bath for coagulation, precipitation or cross-linking of the ejected polymer material.

In some embodiments, the system further comprises a heat source for heating the polymer material prior to delivery to the reservoir or while in the reservoir.

In some embodiments the system is configured for co-deposition of fibers and further includes: a second reservoir configured to hold a second material including a second polymer and rotatable about a second rotation axis. The second reservoir includes: a first end; a second end opposite the first end; an outer sidewall extending from the first end to the second end, a shape of the second reservoir including one or more apertures disposed radially inward from the outer sidewall of the reservoir that are configured to enable a gas to move through the reservoir from the first end to the second end; and one or more orifices formed in the outer sidewall, each of the one or more orifices configured for ejection of the second polymer material radially outward through the orifice as a second ejected jet during rotation of the second reservoir. The system further includes a second plurality of gas flow sources, each configured to direct a flow of gas from upstream of the first end of the second reservoir through the one or more apertures of the second reservoir from the first end to the second end of the second reservoir and downstream of the second end of the second reservoir during rotation of the second reservoir, the plurality of gas flow sources having a converging orientation such that the flows of from the plurality of gas flow sources collectively forming a second combined gas flow in a second direction downstream of the second end of the second reservoir that entrains and deflects the second ejected jet to form a second focused stream of one or more second micron or nanometer dimension polymeric fiber in a second direction, the second direction having an orientation that is within 5 degrees of the rotation axis of the second rotation axis. The first direction and the second direction are oriented for deposition on a same collection surface. In some embodiments, the system is configured for simultaneous deposition of one or more fibers of the first polymer and one or more fibers of the second polymer on the same collection surface.

Some embodiments provide a method for formation and deposition of at least one micron or nanometer dimension polymeric fiber. The method includes rotating a reservoir holding a material comprising a polymer about a rotation axis to eject at least one jet of material from at least one orifice defined by an outer sidewall of the reservoir; directing at least one flow of gas through a portion of the reservoir radially inward of the outer sidewall, the at least one flow of gas directed from an upstream first end of the reservoir to a downstream second end of the reservoir during rotation of the reservoir and ejection of the at least one jet of material to form at least one micron or nanometer dimension polymeric fiber, the at least one flow of gas entraining the one micron or nanometer dimension polymeric fiber and forming a focused fiber deposition stream of the at least one micron or nanometer dimension polymeric fiber in a first direction, the first direction having an orientation of within 5 degrees of the rotation axis of the reservoir; and collecting the focused fiber deposition stream on a target surface.

In some embodiments, the first direction is substantially parallel to the rotation axis of the reservoir.

In some embodiments, the at least one flow of gas comprises a plurality of flows of gas that converge and form a combined gas flow in the first direction. In some embodiments, a flow rate of at least some of the plurality of converging flows of gas relative to others of the plurality of converging flows of gas is controllable to achieve a balanced combined gas flow. In some embodiments, a total gas flow rate of the plurality of converging flows of gas is controllable to change a distance from the reservoir at which the focused fiber deposition stream of the at least one micron or nanometer dimension polymeric fiber has the tightest focus. In some embodiments, the plurality of gas flows comprises three gas flows.

In some embodiments, the focused fiber deposition stream has a substantially tangential orientation to the target surface during fiber collection.

In some embodiments, the method further comprises rotating the target surface during fiber collection.

In some embodiments, the method further comprises at least partially blocking flow of gas from upstream of the reservoir to reduce an effect of airflow upstream of the plurality of gas flow sources on focusing of the fiber deposition stream of the at least one micron or nanometer dimension polymeric fiber.

In some embodiments, the target surface is moved linearly during deposition of the fiber stream.

In some embodiments, the material in the reservoir comprises a solvent.

In some embodiments, the material in the reservoir comprises a polymer melt. In some embodiments, the method further comprises heating the reservoir.

In some embodiments the at least one ejected jet contacts a bath prior to being collected on the target. In some embodiments, the bath comprises a cross-linking agent. In some embodiments, the at least one ejected jet precipitates in the bath forming the at least one micron or nanometer dimension polymeric fiber. In some embodiments, the at least one ejected stream coagulates in the bath forming the at least one micron or nanometer dimension polymeric fiber.

In some embodiments, at least one micron or nanometer dimension polymeric fiber is deposited for reinforcement of a composite material.

In some embodiments, the at least one micron or nanometer dimension polymeric fiber is deposited on one or more items of food.

In some embodiments, the method further includes: rotating a second reservoir holding a second material comprising a second polymer about a second rotation axis to eject at least one jet of second material from at least one orifice defined by an outer sidewall of the second reservoir. The method also includes directing at least one second flow of gas through a portion of the second reservoir radially inward of the outer sidewall, the at least one second flow of gas directed from an upstream first end of the second reservoir to a downstream second end of the second reservoir during rotation of the second reservoir and ejection of the at least one jet of second material to form at least one micron or nanometer dimension polymeric fiber of the second polymer, and the at least one second flow of gas entraining the at least one micron or nanometer dimension polymeric fiber of the second polymer and forming a second focused fiber deposition stream. The method also includes collecting the second focused fiber deposition stream on the target surface. In some embodiments, the collection of the first focused fiber deposition stream overlaps in time with the collection of the second focused fiber deposition stream Some embodiments provide a method of forming a three dimensional tissue scaffold including performing any of the methods described herein where the target surface is a three dimensional shape for a tissue scaffold. In some embodiments, the method also includes rotating the target for deposition on more than one side of the three dimensional shape.

The embodiments disclosed herein meet these and other needs by providing a systems and methods for stream fiber deposition.

Other features and advantages of the invention will be apparent from the following detailed description and claims.

BRIEF DESCRIPTION OF THE DRAWINGS

FIG. 6A is a background-subtracted image of a rotary jet spinning system for stream fiber deposition without a flow blocker producing a focused fiber stream, in accordance with some embodiments.

FIG. 6B is an average of background-subtracted images of the rotary jet spinning system of FIG. 6A without a flow blocker during production of a focused fiber stream illustrating the average fiber stream distribution.

FIG. 6C is a scanning electron microscope image of fibers produced by the system of FIG. 6A without a flow blocker.

FIG. 7A is a background-subtracted image of a rotary jet spinning system for stream fiber deposition including a flow blocker producing a focused fiber stream, in accordance with some embodiments.

FIG. 7B is an average of background-subtracted images of the rotary jet spinning system of FIG. 7A with a flow blocker during production of a focused fiber stream illustrating the average fiber stream distribution.

FIG. 7C is a scanning electron microscope image of fibers produced by the system of FIG. 7A with a flow blocker.

DETAILED DESCRIPTION

Figure 1A:
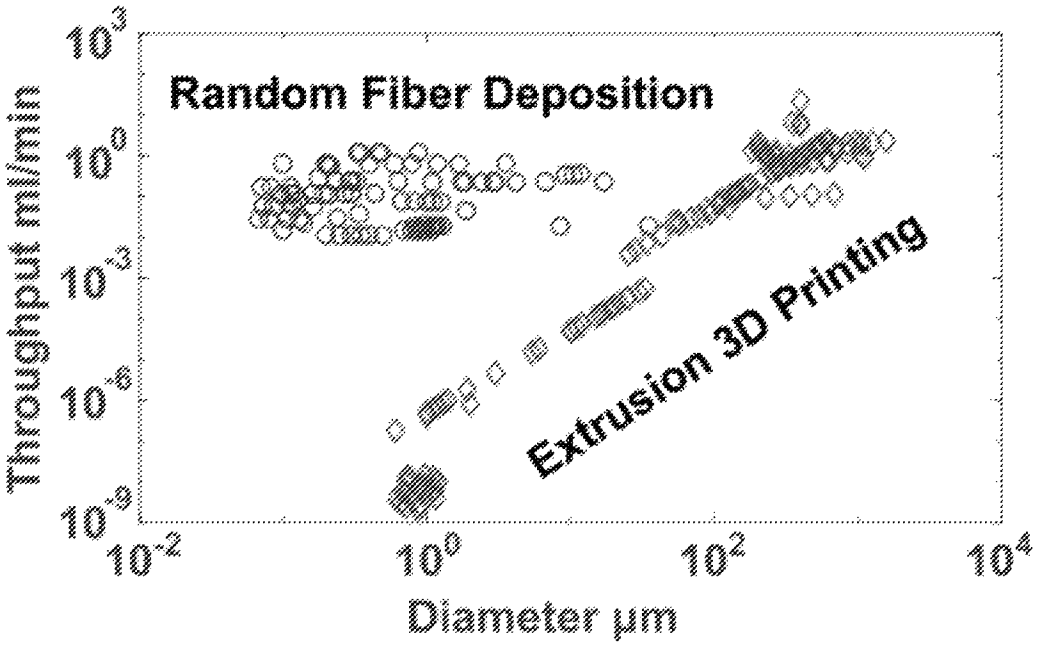
FIG. 1A is a graph of fiber throughput versus diameter for some conventional random fiber deposition techniques (circles) and some conventional extrusion 3D printing techniques (diamonds).
Figure 1B:
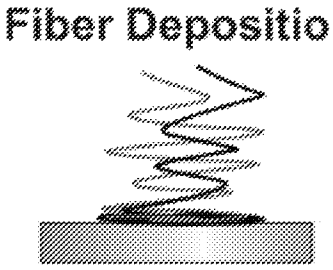
FIG. 1B schematically depicts conventional random fiber deposition.
Figure 1C:
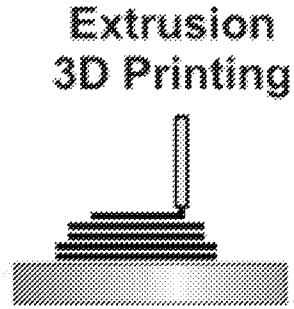
FIG. 1C schematically depicts conventional extraction 3D printing.

In the following description, it is understood that terms such as "top," "bottom," "middle," "outward," "inward," and the like are words of convenience and are not to be construed as limiting terms. Reference will now be made in detail to embodiments of the disclosure, which are illustrated in the accompanying figures and examples. Referring to the drawings in general, it will be understood that the illustrations are for the purpose of describing particular embodiments of the disclosure and are not intended to limit the same.

Whenever a particular embodiment of the disclosure is said to comprise or consist of at least one element of a group and combinations thereof, it is understood that the embodiment may comprise or consist of any of the elements of the group, either individually or in combination with any of the other elements of that group.

As used herein, the terms "polymer fiber" and "polymeric fiber" refer to a fiber comprising a polymer. The fiber may also include some non-polymer components.

As used herein, a micron or nanometer dimension fiber refers to a fiber having a diameter of less than about 10 μm.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

Some embodiments described herein include methods and systems for forming micron-scale diameter to nanometer-scale diameter polymer fibers by ejection of a fiber forming liquid from a spinning reservoir that employ gas (e.g., air) flows to focus and align the produced fibers in a fiber stream for controlled deposition. In some embodiments, the throughput of the microfiber production in length of fiber per time is at least 80 km/min. In some embodiments, the throughput of the microfiber production is in a range of 1 m/min to 150 km/min. In some embodiments, the throughput of the microfiber production is in a range of 100 m/min to 150 km/min. In some embodiments, the throughput of the microfiber production is in a range of 1 km/min to 150 km/min. In some embodiments, the throughput of the microfiber production is in a range of 80 km/min to 150 km/min. In some embodiments, the throughput of the microfiber production is in a range of 80 km/min to 100 km/min. In some embodiments, the deposited fibers conform to various 3D geometries with control of alignment of the fibers.

Some conventional high throughput approaches have tried to deposit onto 3D shaped targets to achieve 3D fibrous structures; however, the fibers often do not conform to the target shape and often exhibit overhanging fibers. Some conventional approaches have employed rotation of a target to achieve circumferential fiber alignment; however, this method cannot handle more complex alignment observed in real tissues, such as the helical alignment in heart ventricles, or the tri-layer structure in heart valves with circumferential and longitudinal alignment on different layers In some embodiments, systems and method have improved structural controllability as compared with conventional high-throughput fiber deposition techniques for fibers at the micron to nanometer-scale diameter. Some embodiments of systems and methods described herein employ stream fiber deposition (Stream-FD) where fibers are structured into a spatially confined and aligned fiber stream before deposited onto the target. Well-structured fiber streams enable well-structured deposition. Stream-FD enables accurate control over both conformity and deposition alignment without sacrificing the throughput.

Fibers are formed by ejection and subsequent solidification of one or more jets of a fiber forming liquid (e.g., a material comprising a polymer and referred to herein as a polymer material) from one or more orifices of a rotating reservoir under centrifugal force through a rotary jet spinning process. The reservoir including the one or more orifices may be referred to herein as a spinneret. In embodiments described herein, specific aerodynamics of gas flows (e.g., air flows) are employed to confine the produced fiber distribution and align it in the fiber stream. Confining the fiber distribution requires a convergent air flow that brings fibers together as they flow away from the reservoir. Aligning the fibers requires an accelerating air flow that pulls fibers straight. In addition, the perturbation to the flow near the reservoir (e.g., the spinneret) should be minimized to avoid interfering with fiber formation. In some embodiments, these requirements may be realized by blowing gas (e.g., air) from at or near a rotational axis of the reservoir.

Figure 2A:
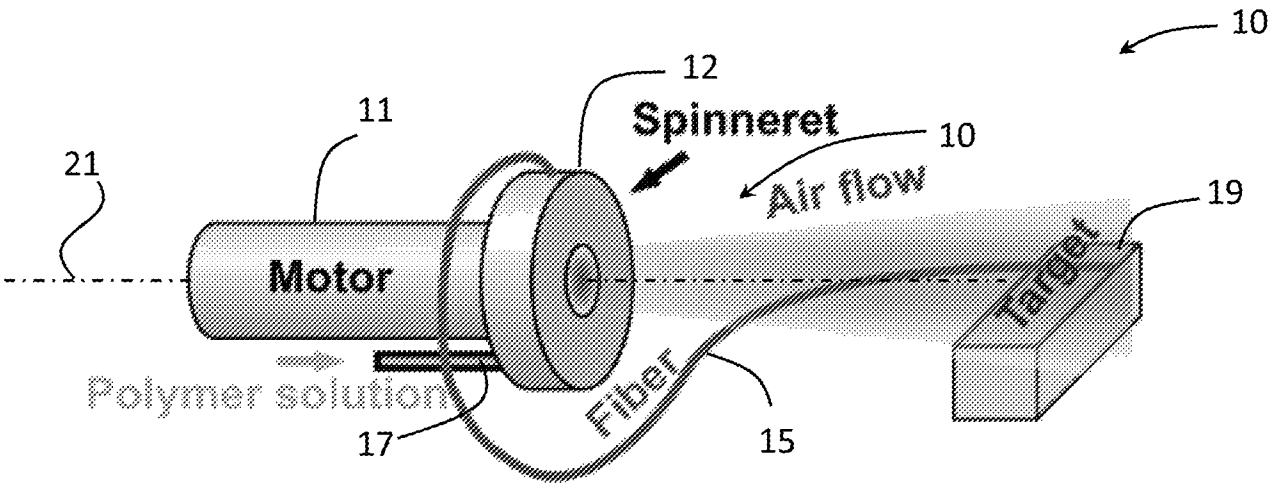
FIG. 2A schematically depicts a rotary jet spinning system modified with air flow for stream fiber deposition in accordance with some embodiments.

FIG. 2A schematically depicts an example rotary jet spinning system 10 including a rotational motion generator (e.g. a motor) 11 that rotates a reservoir 12 including an orifice, which is referred to herein as a spinneret, in accordance with some embodiments. The system employs a gas flow (e.g., an air flow) 30 to converge and align a stream of a fiber 15 produced by ejecting a polymer solution 17 from the spinneret 12 before the fiber is deposited on a target 19. In some embodiments, the gas flow may be a gas jet or air jet located at or near the axis of rotation 21 of the spinneret/reservoir 12, and may be directing a flow oriented parallel to or near parallel to the axis of rotation 21. The gas flow is not a uniform flow over the area of the rotor. In some embodiments, the flow concentrated in one or more central portions of the rotor spaced radially inward from a sidewall of the rotor. In some embodiments, downstream of the rotor, the air flow has a higher velocity at or near the rotational axis of the rotor that falls at locations that are laterally displaced from the rotational axis.

Rotary jet spinning produces a fiber or fibers by centrifugal force, thus generating a fiber cloud surrounding the spinneret 12 moving azimuthally and radially outward. As the gas flow (e.g., an air jet) 30 is thrusted from one or more central portions of the spinneret, the gas flow 30 pulls surrounding air into the jet in a phenomenon known as entrainment. The entrainment flow is orders of magnitude slower than the flow inside the jet, which has minimal perturbation over the fiber formation. The entrainment is converging and accelerating towards the jet, which confines and aligns the fibers into a stream as is shown in the visualization of a fiber stream in FIG. 2B, which was produced by superimposing different frames from a video of fiber deposition.

Additional details of some embodiments of rotary jet spinning systems and methods are described below with respect to FIGS. 3A-G. In the embodiment of FIGS. 3A-G, the system employs multiple gas flows that combine to form a combined gas flow for converging and aligning the fiber stream. Further, the multiple gas flows flow through apertures in the reservoir radially inward of the one or more orifices before forming the combined flow in accordance with some embodiments.

Referring to FIGS. 3A-G, embodiments of the rotary jet spinning system 10 include at least one reservoir 12 configured to rotate about a rotational axis 21. Some systems may also include a rotational motion generator (e.g., a motor) 11 that rotates the reservoir.

In some embodiments, reservoir 12 has a first end 14, a second end 16 opposite the first end 14, and an outer sidewall 18 extending from the first end 14 to the second end 16. Reservoir 12 is configured and adapted to hold a material for forming polymer fibers (e.g., a polymer material). Reservoir 12 defines one or more orifices 22 in the outer sidewall 18. Reservoir 12 is configured and adapted to eject the polymer material radially outward through one or more orifices 22 formed in the outer sidewall 18 under pressure caused by rotation of the reservoir 12. Each of the one or more orifices 22 may be configured for ejection of the polymer material radially outward through orifice 22 as an ejected jet 24 during rotation of reservoir 12.

In some embodiments, the reservoir defines one or more apertures 20*a*, 20*b*, 20*c* disposed radially inward from the outer sidewall 18 that are configured to enable a gas to move past or through the reservoir 12 from the first end 14 to the second end 16. In some embodiments, reservoir 12 may define three apertures 20*a*, 20*b*, 20*c* disposed radially inward from the outer sidewall 18. In other embodiments, the reservoir 12 may define more than three apertures disposed radially inward from the outer sidewall 18. In some embodiments, the reservoir may define 2, 3, 4, 5, 6, 7, 8, 9, 10, 11, 12, 13, 14, 15, 16, 17 or 19 apertures disposed radially inward from the outer sidewall 18. One of ordinary skill in the art in view of the present disclosure will appreciate that different geometries of apertures and different numbers of apertures fall within the scope of the present invention.

Rotary jet spinning system 10 further includes one or more gas flow sources 28*a*, 28*b*, 28*c* used to form the gas flow, which is also referred to herein as the gas jet (e.g., the air jet) for converging and aligning the fiber stream in accordance with some embodiments. In some embodiments, rotary jet spinning system 10 includes a plurality of gas flow sources 28*a*, 28*b*, 28*c*, each configured to direct a flow of gas from upstream of the first end 14 of reservoir 12, through apertures 20*a*, 20*b*, 20*c* from the first end 14 to the second end 16, and downstream of the second end 16 of the reservoir 12. In some embodiments, the plurality of gas flow sources 28*a*, 28*b*, 28*c* have a converging orientation such that the flow from the plurality of gas flow sources collectively forms a combined gas flow or gas jet 30 in a first direction downstream of the second end 16 of reservoir 12. In some embodiments, the first direction is substantially parallel with respect to the rotational axis 21. FIG. 3F includes arrows indicating gas flows 30*a*, 30*b*, 30*c* from the plurality of gas flow sources 28*a*, 28*b*, 28*c* and a combined gas flow 30 aligned with the rotational axis 21. As illustrated in FIG. 3F, gas flows 30*a*, 30*b*, 30*c*, directed from the gas flow sources 28*a*, 28*b*, 28*c*, may converge to form a combined gas flow 30 at a position downstream of the second end 16 of reservoir 12. In some embodiments, the gas flow sources 28*a*, 28*b*, 28*c* may converge to form a combined gas flow in a range of 2 centimeters to 10 cm downstream of the second end 16 of reservoir 12. In some embodiments, the flows from the gas flow sources may converge further than 10 cm from the second end 16 of the reservoir. The combined gas flow 30 may entrain the ejected jets 24 to form a focused stream of a micron or nanometer dimension polymeric fibers 32 in a first direction. In a non-limiting example, the plurality of gas flow sources may converge and homogenize at a distance about 3 centimeters downstream of the second end 16 of reservoir 12. At such distance, the air flow rate may be between about 10 m/s and about 30 m/s in some embodiments.

In some embodiments, the first direction may be at an angle with respect to rotational axis 21. In some embodiments, the first direction may be within 5 degrees of the longitudinal axis A1. In some embodiments, the first direction may be within 3 degrees of the longitudinal axis A1. In some embodiments, the first direction has an angle in a range of zero to 5 with respect to the rotational axis 21.

As noted above, in some embodiments, a rotary jet spinning system 10 may include a gas flow system that includes the one or more gas flow sources (e.g., nozzles) 28*a*, 28*b*, 28*c*. The one or more gas flow sources 28*a*, 28*b*, 28*c* may be independently supplied with a gas flow, or may all receive a gas flow from a common supply before it is split into the one or more gas flow sources 28, 28*b*, 28*c*. In some embodiments, the one or more gas flow sources may be part of a single gas flow unit or fixture 26 as illustrated in FIGS. 3A, 3D, and 3G.

Figure 4A:
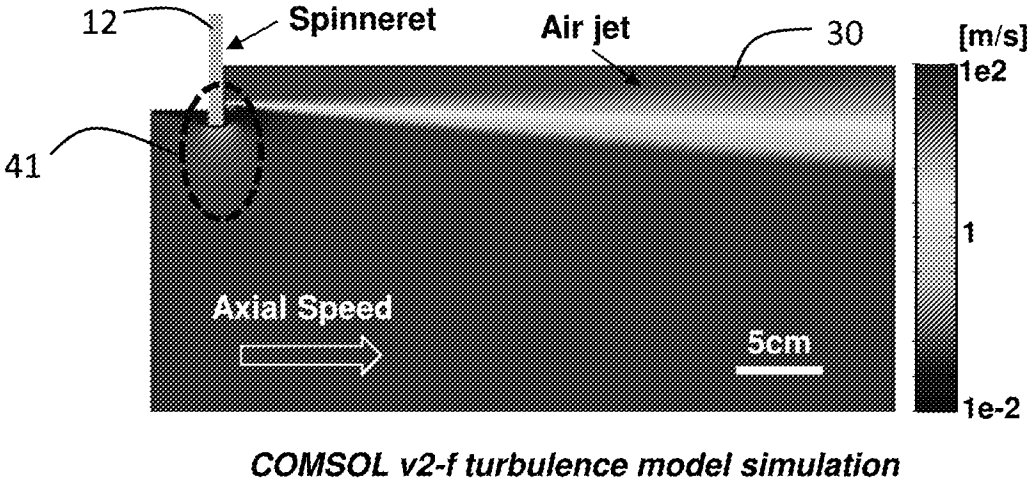
FIG. 4A is a plot of axial air flow velocity from simulation of a rotary jet spinning system for stream fiber deposition in accordance with some embodiments.
Figure 4B:
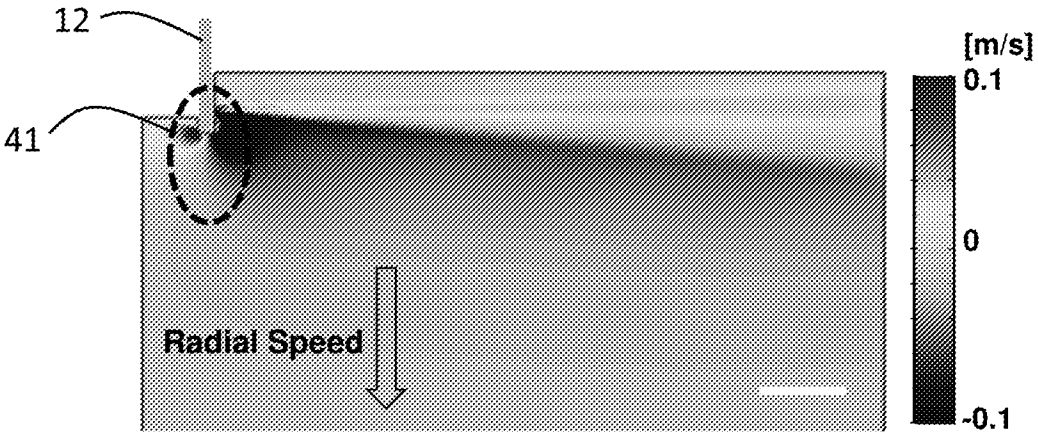
FIG. 4B is a plot of radial air flow velocity from a simulation of a rotary jet spinning system for stream fiber deposition in accordance with some embodiments.

In operation, the gas flow or gas jet 30, which may be a combined gas flow, entrains and deflects the ejected stream to form a focused stream of micron or nanometer dimension polymeric fiber(s) in the first direction. The gas flow through the reservoir at or near the rotation axis does not interfere with the fiber formation. FIGS. 4A and 4B show turbulence model simulations of a flow field around a spinneret 12 with an applied central air jet 30 from a central portion of the spinneret or reservoir. Even for a substantial air jet, the presence of the central air jet causes minimal perturbation in the flow field at the fiber forming region 41 in either the axial direction (FIG. 4A) or in the radial direction (FIG. 4B) and thus, does not interfere with fiber formation. In contrast, if the reservoir were subject to a uniform extrinsic air flow parallel to the rotational axis instead of an extrinsic air flow through a central portion of the reservoir, the uniform extrinsic air flow would interfere with fiber formation in the fiber forming region 41 and could cause fiber entanglement.

Figure 2B:
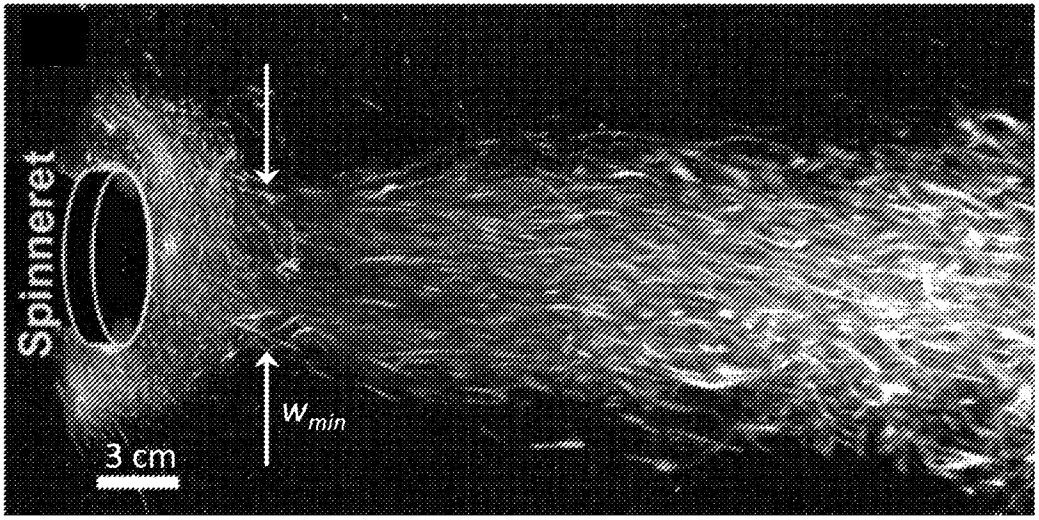
FIG. 2B is an image of a stream of fibers during deposition generate by superimposing frames of a video of fiber deposition and indicating a stream waist in accordance with some embodiments.

In some embodiments, reservoir 12 may begin rotating without gas flow (e.g., air flow) being applied. Gas flow (e.g., air flow) may be gradually increased until a focus of the stream of micron or nanometer dimension polymeric fiber(s) is achieved. FIG. 2B illustrates a focused stream of fibers and indicates a stream waist $w_{min}$ where the stream is most narrow. In some embodiments, the waist of the fiber stream may be located at a distance of between 3 cm and 7 cm from the orifices of the reservoir as measured along the rotational axis. If the flow rate is too low, the fibers will fail to align or fail to align properly. A higher flow rate would enable alignment and collection of the fibers at a distance further away from reservoir 12. Collection of the fibers at a distance further away from reservoir 12 may be beneficial to ensure the drying of the fibers and/or to allow the fibers to distribute over a larger area/deposit over a larger target; however, at larger distances from the reservoir the fiber stream widens and the fibers may slow down and buckle. In some embodiments, the fibers are deposited on to a surface of a collector or target at a distance of 2 cm to 20 cm from the orifices as measured along the rotation axis, In some embodiments, the fibers are deposited onto a surface of a collector or target at a distance of 3 cm to 20 cm from the orifices as measured along the rotation axis. In some embodiments, the fibers are deposited onto a surface of a collector or target at a distance of 4 cm to 20 cm from the orifices as measured along the rotation axis. In some embodiments, the fibers are deposited onto a surface of a collector at a range of 3 cm to 50 cm from the orifices as measured along the rotation axis.

In some embodiments, arrangement of the plurality of gas flow sources may be configured such that, at any single point in time during rotation of the reservoir, gas flows from all of the gas flow sources flows through apertures of the reservoir, or gas flows from the all the gas flow sources are blocked by reservoir. In this manner, the combined gas flow will not be deflected from the intended direction by only some of the gas flows being blocked at a point in time resulting in an unbalanced combined gas flow. For example, the gas flow source arrangement and the reservoir in the system of FIGS. 3A-F are configured such that at any moment in time, gas flows from all three gas flow sources 28*a*, 28*b*, 28*c* flow through the apertures 20*a*, 20*b*, 20*c* of the reservoir 12, or gas flows from all three gas flow sources 28*a*, 28*b*, 28*c* are substantially blocked by portions of the reservoir 12 between the apertures 20*a*, 20*b*, 20*c*. In other embodiments, there may be a sufficient number of gas flows such that the combined flow can be balanced even when a subset of the gas flows are blocked. For example, for an embodiment with six gas flows symmetrically arranged around the rotational axis and three apertures in the reservoir symmetrically arranged about the rotational axis, at some point in rotation of the reservoir every other gas flow would be blocked, but the combined gas flow could still be balanced.

In some embodiments, the gas flow sources 28*a*, 28*b*, 28*c* may be controllable to achieve a balanced combined gas flow. For example, a flow rate through the gas flow sources may be adjustable, or a direction or orientation of flow from the gas flow sources may be adjustable. In some embodiments, the gas flow sources 28*a*, 28*b*, 28*c* may be controllable to change a distance from the reservoir 12 or from the orifice at which the stream of the micron or nanometer dimension polymeric fiber 32 has the tightest focus, which is also referred to herein as the stream waist (see FIG. 2B). In some embodiments, the distance along the first direction between the orifices and the stream waist may be a range of about 3 cm to about 7 cm. In other embodiments, the distance may be shorter than this range or may be larger than this range. In some embodiments, the gas flow rate may be adjustable. In some embodiments, during fiber formation and deposition, the gas pressure may be in the range of about 0.1 MPa and about 0.5 MPa.

Figure 3B:
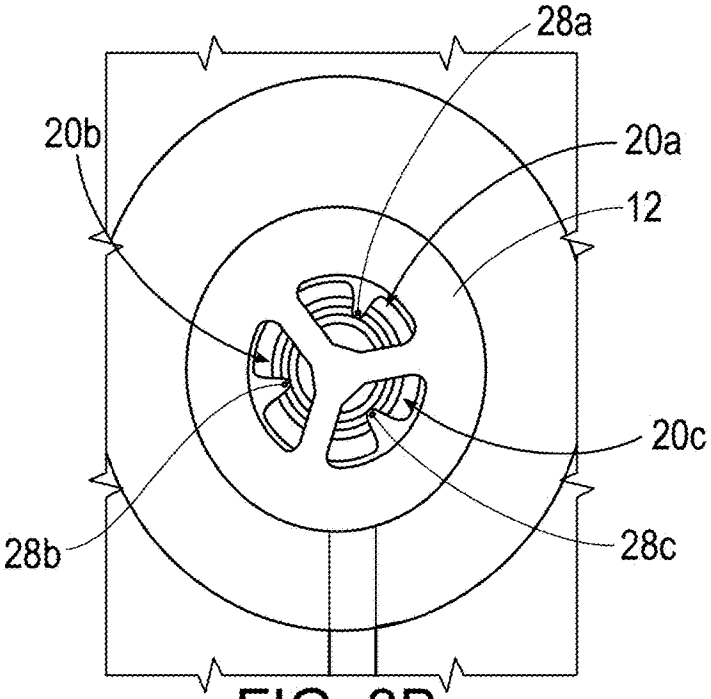
FIG. 3B is an image of a front view of the rotary jet spinning system of FIG. 3A.
Figure 3A:
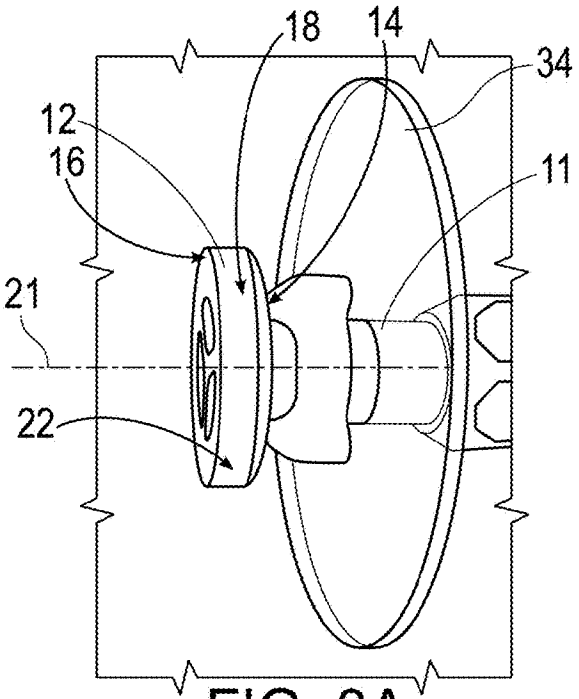
FIG. 3A is a perspective image of a rotary jet spinning system for stream fiber deposition including multiple gas flow sources that blow gas through apertures of a reservoir to form a combined gas flow in accordance with some embodiments.
Figure 3E:
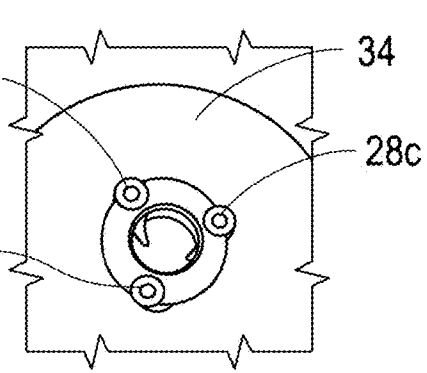
FIG. 3E is a perspective view of a flow blocker coupled to the fixture for the multiple gas flow sources in the rotary jet spinning system of FIG. 3A in accordance with some embodiments.
Figure 3D:
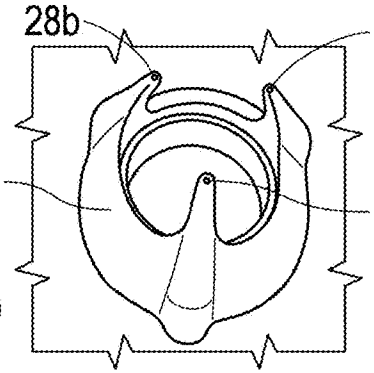
FIG. 3D is a perspective image of a fixture for the multiple gas flow sources in the rotary jet spinning system of FIG. 3A in accordance with some embodiment.
Figure 3C:
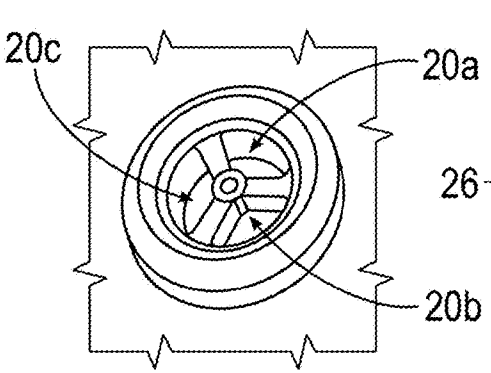
FIG. 3C is a perspective image of the reservoir of the rotary jet spinning system of FIG. 3A in accordance with some embodiments.
Figure 3G:
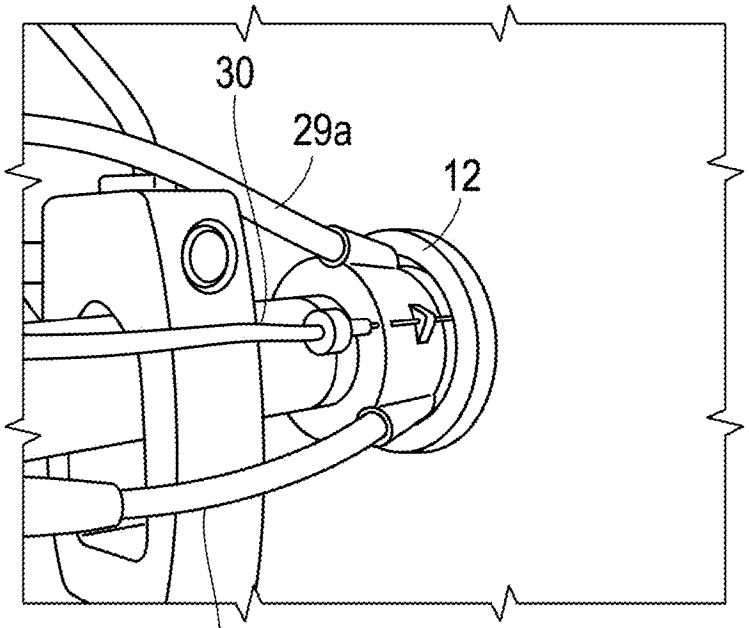
FIG. 3G is a back perspective view of the reservoir, the fixture, and the supply lines in accordance with some embodiments.
Figure 3F:
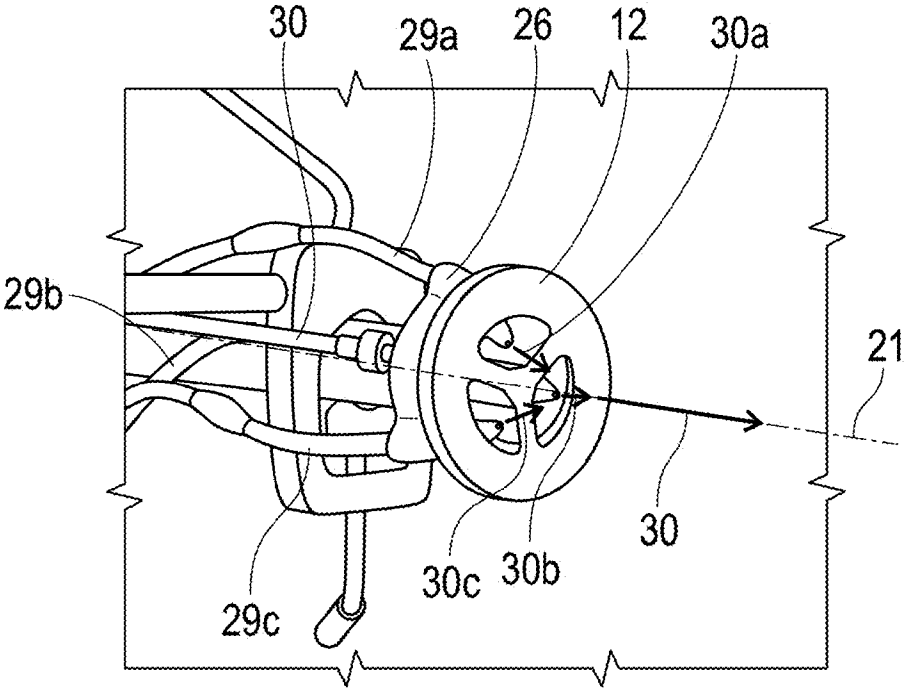
FIG. 3F is a front perspective view of the reservoir, a supply line for a polymer material to be delivered to the reservoir, the fixture for the multiple gas flow sources and supply lines for the multiple gas flow sources in accordance with some embodiments.

In some embodiments, rotary jet spinning system 10 may include a flow blocker 34 positioned upstream of the first end 12 of the reservoir 12 (see FIGS. 3A, 3B and 3E). A flow blocker 34 may provide additional control of vortices generated by the flow of gas and the rotation of reservoir 12, thereby improving control of a lateral area of deposition of the micron or nanometer dimension polymeric fiber as the fiber travels towards a target.

In some embodiments, a flow blocker 34, which may also be referred to as a flow regulator herein, may be used to achieve a longer collecting distance by preventing stronger air flow from overly perturbing the fiber formation near reservoir 12. As noted above, the flow blocker 34 may be positioned upstream of the first end 14 of reservoir 12. In some embodiments, the flow blocker 34 may be positioned at distance between about 2 cm and about 10 cm upstream of the first end 14 of reservoir 12. In some embodiments, the flow blocker is positioned about 5 cm upstream of the first end 14 of the reservoir. In some embodiments, the flow blocker 34 is stationary and does not rotate. In other embodiments, the flow blocker 34 may be configured to rotate with or separate from reservoir. The flow blocker 34 has a diameter equal to or greater than reservoir 12 in accordance with some embodiments. For example, in some embodiments, flow blocker 34 has a diameter that is in the range of about 1 to about 5 times the diameter of reservoir 12] In other embodiments, the flow blocker may have a larger diameter. The diameter of flow blocker 34 may, in part, be selected based on the location of flow blocker 34 with respect to reservoir 12. For example, a larger flow blocker 34 placed further from reservoir 12 may have a similar effect as a smaller flow blocker 34 placed closer to reservoir 12. In some embodiments, a flow blocker may not be required for deposition onto a collector relatively close to the reservoir, but a flow blocker may be needed for collection at distances further from the reservoir (e.g., at distances of greater than 20 cm from the reservoir, at distances of greater than 30 cm from the reservoir, or at distances of greater than 50 cm from the reservoir).

Figure 5A:
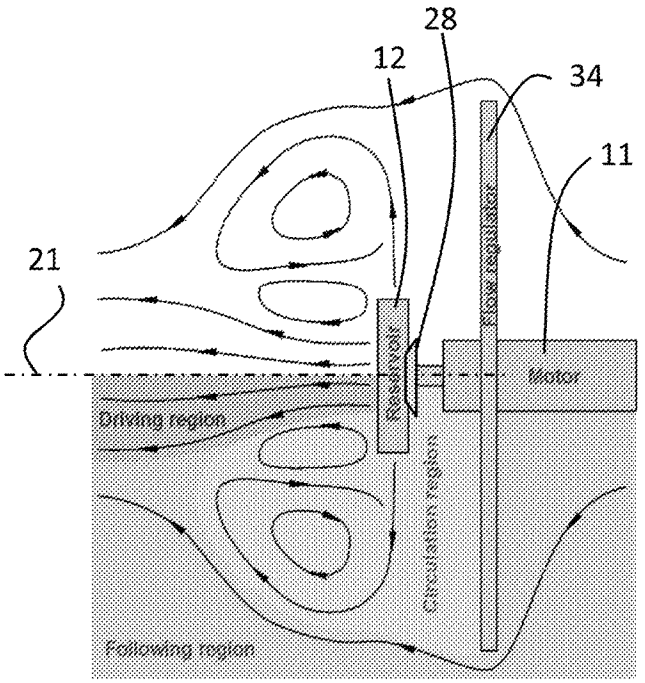
FIG. 5A schematically depicts airflow around a rotary jet spinning system for stream fiber deposition including a flow blocker upstream of the reservoir in accordance with some embodiments.

FIG. 5A schematically depicts streamlines of gas flow around the system and the impact of a flow blocker 34 on the gas flow. The gas flows are dominated by the radial and azimuthal gas flows cause by rotation of the reservoir and the extrinsic applied gas flow through a central portion of the reservoir. In the circulation region, vortices form due to competition between the centripetal flow from the rapid rotating reservoir and the entrainment flow of the air jet blown from the center of the reservoir. The extrinsic flow in the driving region also entrains a flow of gas from beyond the circulation region and upstream of the reservoir and the flow blocker that flows in the following region. Flow blocker 34 may alter (e.g., block) at least some air flow from upstream of the reservoir and influence the size and shape of the vortices in the circulation region.

Figure 5B:
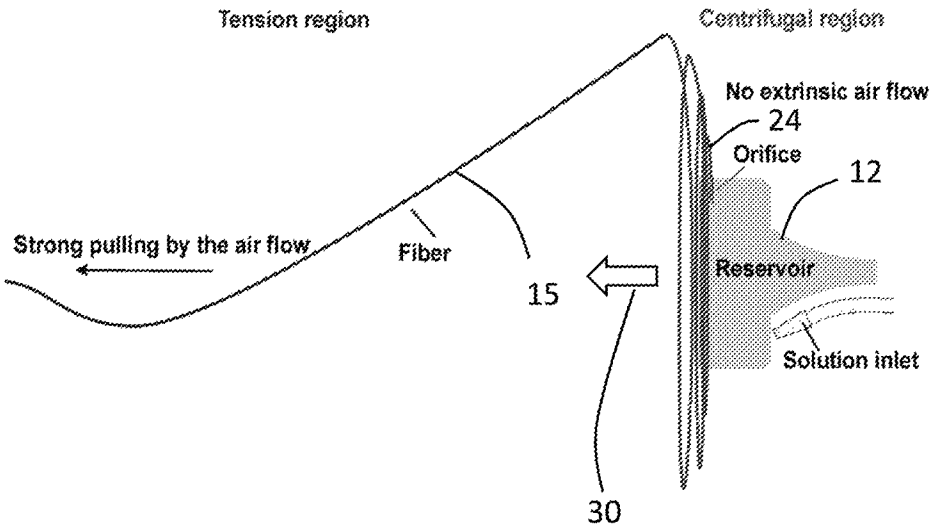
FIG. 5B schematically depicts a jet of polymer material that solidifies into a fiber and air flow pulling on the formed fiber in accordance with some embodiments.

FIG. 5B schematically depicts a polymer jet 24 under the influence of flow in the centrifugal region where it undergoes centrifugal force due to ejection from the reservoir in the presence of no extrinsic air flow and a resulting fiber 15 in the tension region where it is entrained by the extrinsic air flow 30 and is subject to tension. In this schematic, the one or more gas flow sources used to generate the extrinsic air flow 30 not shown for simplicity.

Figure 5C:
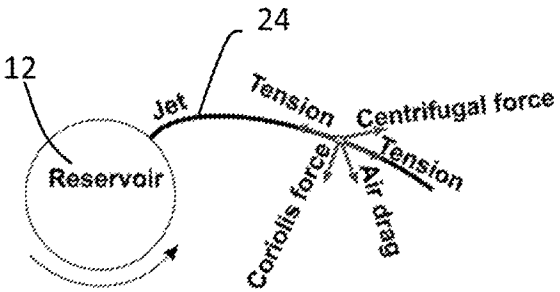
FIG. 5C schematically depicts an axial view of the reservoir and forces acting on a jet of polymer material after ejection from the reservoir in accordance with some embodiments.

FIG. 5C schematically depicts an axial view of the reservoir and illustrates that various forces acting on an ejected jet of polymer material from the reservoir during the fiber formation process.

FIGS. 6A-6C and 7A-7C illustrate the effect of a flow blocker in accordance with some embodiments. In a non-limiting example, FIGS. 6A-6C corresponding to production of fibers by a rotary jet spinning system 10 for stream fiber deposition that does not include flow blocker 34. In contrast, FIGS. 7A-7C correspond to the production of fibers by a rotary jet spinning system 10 for stream fiber deposition that does include a flow blocker 34. The background subtracted image during fiber deposition of FIG. 7A shows less turbulence downstream of the reservoir 12 with use of the flow blocker 34 as compared with the background subtracted image of FIG. 6A where a flow blocker was not employed. In some embodiments, the flow blocker 34 provides additional control of vortices generated by the flow of gas and the rotation of reservoir 12, thereby improving control of a lateral area of deposition of polymer fiber as the fiber travels towards a target. Fibers extend further before focused into stream with a flow blocker shown in FIG. 7B. The flow blocker 34 suppresses the drag region leading to better fiber morphology. The SEM images of FIG. 6C and 7C compare morphologies of the resulting fibers. The images illustrate the more uniform fiber diameters and reduced curling of the fibers for the fibers produced with a flow blocker. Samples were collected 20 cm downstream from the reservoir.

Although some embodiments of systems are depicted herein as including a flow blocker, system and methods described herein need not include, incorporate or employ a flow blocker or flow regulator upstream of the reservoir. In some embodiments, the fiber morphology, distribution, and fiber alignment in the deposition may be acceptable even without use of a flow blocker. As noted above, in some embodiments, whether a flow blocker is needed or is employed may be determined, at least in part, on a distance between the reservoir and a surface on which fibers are collected.

Although some embodiments are described herein as having multiple gas flows that converge to a single gas flow that entrains the fibers and converges and focuses the gas stream, in other embodiments, a single gas flow directed along the axis of rotation of the reservoir may be employed.

Figure 8A:
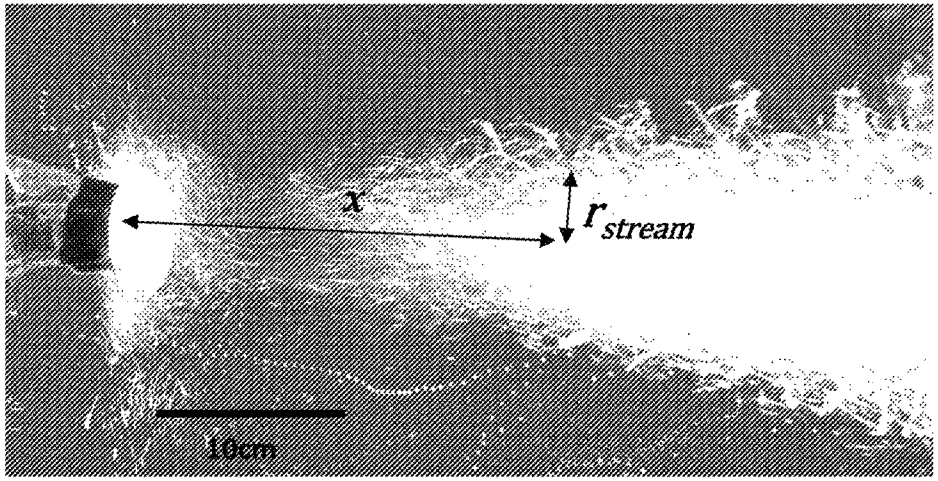
FIG. 8A is the maximum intensity overlay of 3600 frames over a larger field of view taken at 1/800 s exposure, 1/60 s difference, during fiber creation and deposition to show fiber stream broadening downstream of the stream waist, in accordance with some embodiments.
Figure 8B:
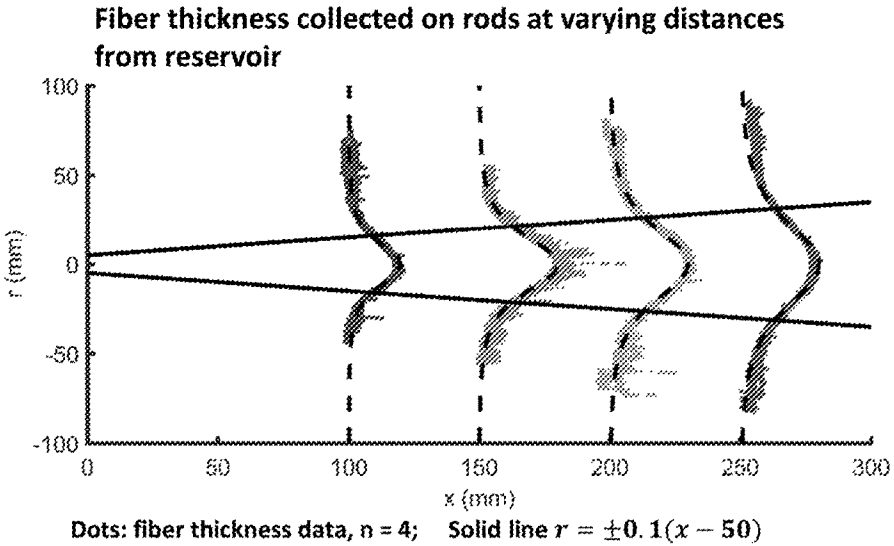
FIG. 8B is a plot of thickness profiles for fiber collection on rotating target rods at different distances from the reservoir to quantify fiber stream broadening, in accordance with some embodiments.

For some systems and methods described herein, after the central gas flow focuses the fiber stream down to a waist, the fiber stream widens proportional to the distance from the reservoir, as would be predicted for turbulent jet widening. FIG. 8A is a wide field of view image formed from multiple overlaid images of fiber streams and illustrates this widening of the fiber stream $r_{stream}$ with distance from the reservoir x. FIG. 8B is a plot of thickness profiles for collection at different distances from the reservoir. The thickness profiles show a self-similar scaling with $r_{stream}$~0.1 x, which is similar to the self-similar scaling of velocity profiles for turbulent widening of a jet flow. Thus, downstream of the stream waist, the stream width increases proportional to the distance of the collecting target surface from the reservoir.

Figure 9A:
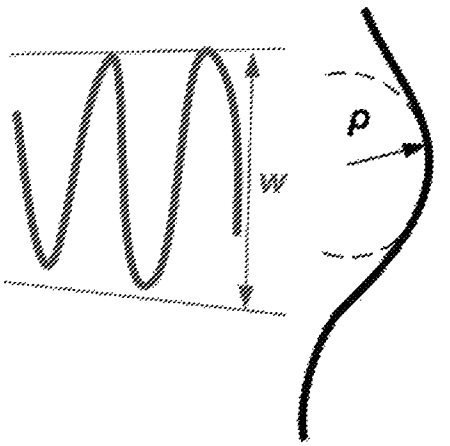
FIG. 9A schematically illustrates length scales of the stream width w and the radius of curvature of the target surface ρ.
Figure 9B:
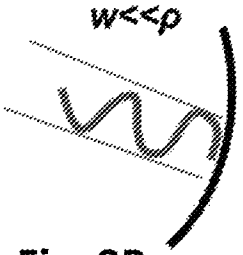
FIG. 9B schematically illustrates when w<<ρ meaning that the target surface is effectively flat for the fiber stream and the deposition conforms to the shape of the target in accordance with some embodiments.
Figure 9C:
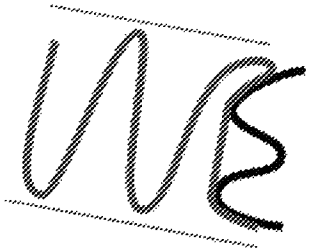
FIG. 9C schematically illustrates when w~ρ or >>ρ and overhanging fibers prevent conformal deposition for a target feature in accordance with some embodiments.
Figure 9D:
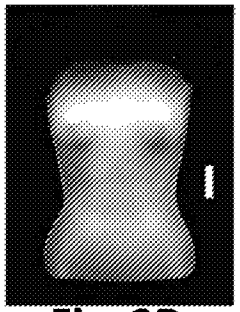
FIG. 9D is an image of conformal deposition on a female mannequin when the radius of curvature of the target surface is greater when the stream width.
Figure 9E:
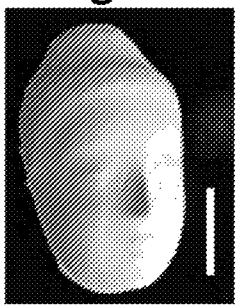
FIG. 9E is an image of conformal deposition on a Buddha face replica having finer features where the radius of curvature of the target surface is smaller than the stream width.
Figure 9F:
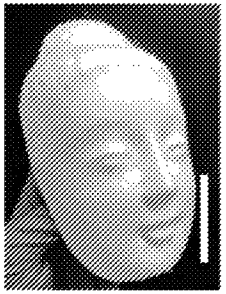
FIG. 9F is an image of the conformal deposition of FIG. 9E after embossing to shape the deposited material to include the fine features.

In some embodiments, a system for rotary jet spinning with stream fiber deposition is configured for conformal deposition onto 3D features. The confinement of the fiber stream is important for conformal deposition onto the 3D features. In terms of length scales, the confinement is characterized by the fiber stream width w, and the 3D feature of the target for deposition is characterized by the local radius of curvature ρ as schematically illustrated in FIG. 9A. As the fiber stream is generated from a random fiber cloud and is constantly perturbed by turbulent fluctuation, the fiber trajectory undulates inside the stream. If the fiber stream width is much less than the curvature of the target surface, $w \ll \rho$, then the target surface is effectively flat for the fiber stream, and the deposition conforms to the target surface as schematically depicted in FIG. 9B. If the fiber stream width is comparable or less than the curvature of the target surface, $w \sim \rho$ or $w \gg \rho$, the curvature has a significant effect on the deposition. If the target surface is convex, the fiber wraps around the target, still resulting in a conformal deposition. If the surface is concave, however, the fiber hangs across the concave part, resulting in non-conformal deposition as illustrated in FIG. 9C. In practice, the width of the fiber stream is determined by the width of the central gas flow, which may scale with the diameter of the spinneret, and which increases linearly with the collection distance. The effect of stream width as compared to feature sizes of the target was illustrated by depositing onto two targets, a 50 cm-tall female mannequin, and a 15 cm-tall Buddha face replicated from a $5^{th}$ century statue from Qingzhou, China using a fixed stream width of about 6 cm. With the larger feature size, where the stream width was about the same size as the feature size on the target, the deposition conformed well to the body feature of the female mannequin (see FIG. 9D). With the comparatively smaller feature size where the stream width was larger than the feature size on the target, the deposition hardly resolved any facial feature on the Buddha face (see FIG. 9E). After embossing, the details of the facial features on the Buddha face are revealed (see FIG. 9F). The scale bars on FIGS. 9D-9F are about 6 cm.

In theory, one could scale down the spinning setup to achieve a smaller stream width for finer feature resolution. In practice, a smaller stream width usually requires a trade-off between throughput and fiber quality. As turbulent fluctuation constantly perturbs the fibers in the fiber stream, the chance for fibers to collide and bundles increases as the fiber density inside the stream increases. Consequently, holding the same throughput while decreasing stream width leads to poorer fiber quality because it requires greater fiber density. Alternatively, keeping the fiber density the same for a smaller stream leads to lower throughput. For targets like the Buddha face in which the fine features only appear as shallow undulation on coarse features, a high through-put deposition could be employed that captures large scale features followed by an embossing (see FIG. 9F).

Figures 10A, 10B, 10C:
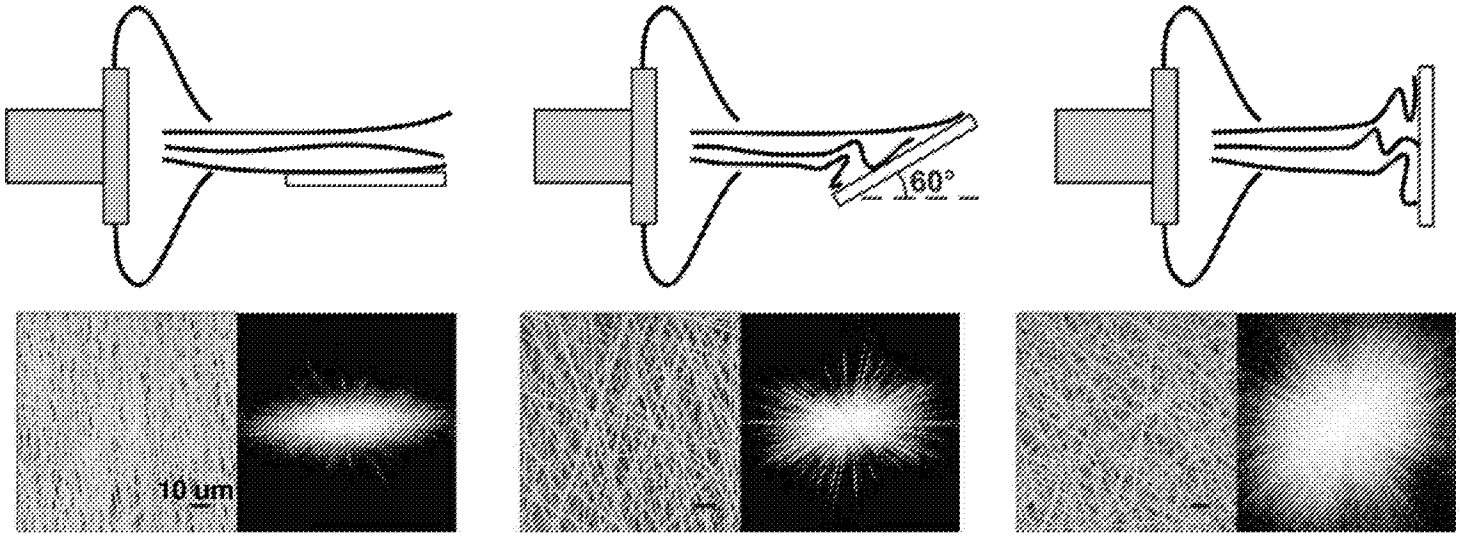
FIG. 10A includes a schematic of depositing a fiber stream onto a tangentially oriented target surface (top), an SEM image of fibers deposited with a tangential deposition orientation showing aligned fibers (bottom left), and a corresponding Fourier image of the fiber orientation (bottom right) in accordance with some embodiments.
FIG. 10B includes a schematic of depositing a fiber stream onto a target surface oriented at a 60° angle to the stream (top), an SEM image of fibers deposited with a 60° deposition orientation showing partially aligned fibers (bottom left), and a corresponding Fourier image of the fiber orientation (bottom right) in accordance with some embodiments.
FIG. 10C includes a schematic of depositing a fiber stream onto a target surface oriented perpendicular to the stream (top), an SEM image of fibers deposited with the perpendicular orientation showing little to no preferential alignment of fibers (bottom left), and a corresponding Fourier image of the fiber orientation (bottom right) in accordance with some embodiments.
Figure 10D:
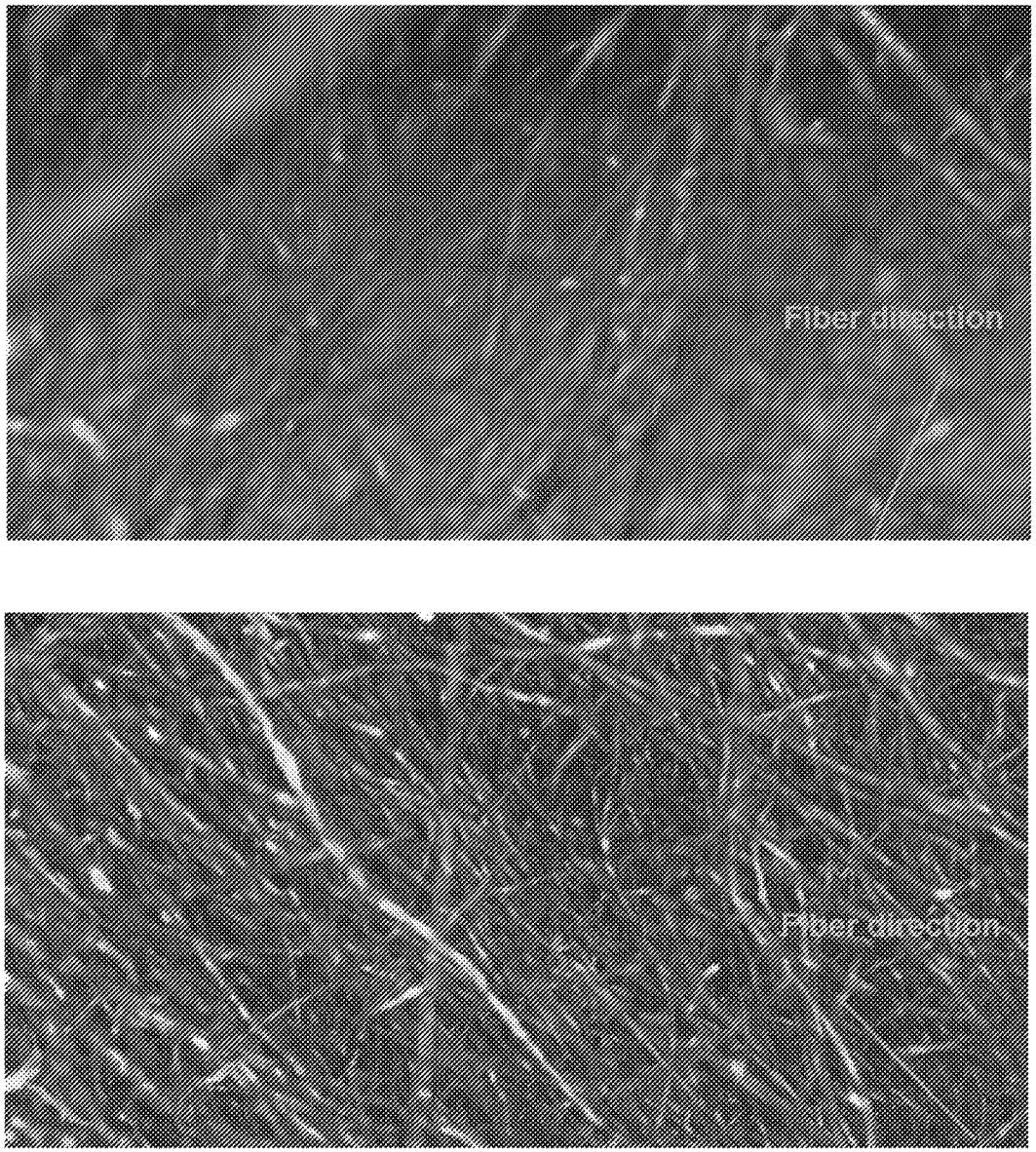
FIG. 10D includes a schematic of depositing onto a rotating tangentially oriented surface (left) and CT images of the resulting fiber structure at a first depth (top right) and at a second depth (bottom right) that is 360 microns deeper showing the rotation of the alignment of the fibers with depth in accordance with some embodiments.
Figure 10D:
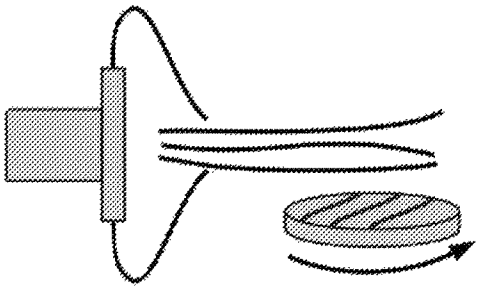
Figure 10E:
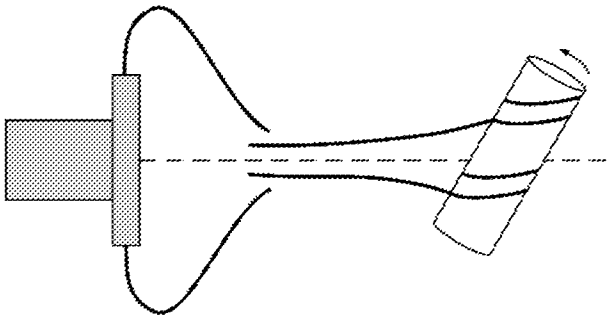
FIG. 10E includes a schematic of depositing onto a surface of a rotating cylinder oriented at an acute angle relative to the fiber stream at a relatively slow rotational speed (top), an optical profilometry image of the fiber orientation (bottom left) and a Fourier transform image (bottom right) showing the helical alignment of the fibers in accordance with some embodiments.
Figure 10E:
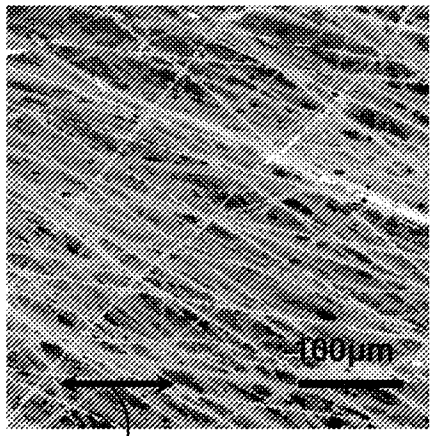
Figure 10E:
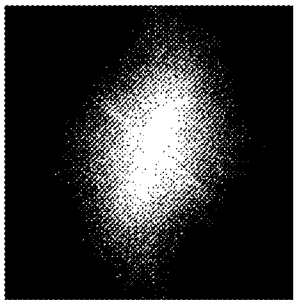
Figure 10F:
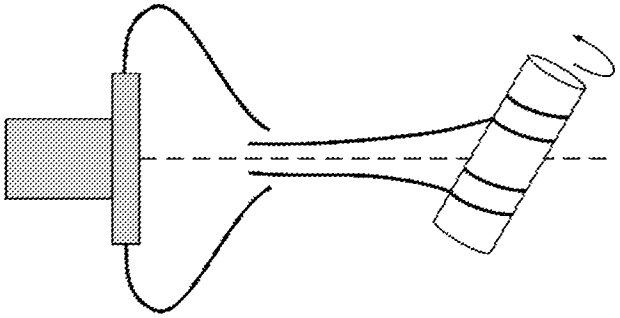
FIG. 10F includes a schematic of depositing onto a surface of a rotating cylinder oriented at an acute angle relative to the fiber stream at a relatively fast rotational speed (top), an optical profilometry image of the fiber orientation (bottom left) and a Fourier transform image (bottom right) showing the helical alignment of the fibers in accordance with some embodiments.
Figure 10F:
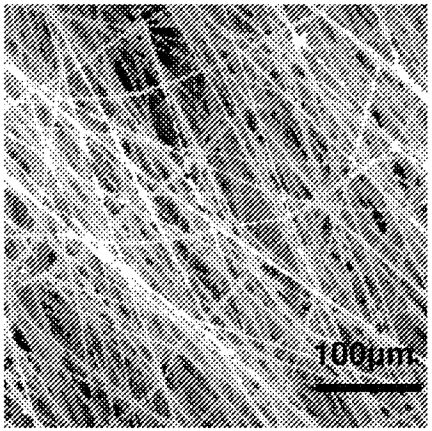
Figure 10F:
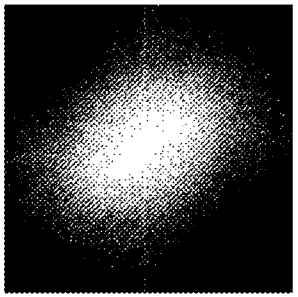

In some embodiments, alignment of the fiber(s) in the fiber stream enables systems and methods to control alignment of the deposition by varying the deposition angle. If the fiber stream hits the surface of the target with a tangential orientation as schematically depicted in the top image of FIG. 10A, the flow field of the air jet is minimally perturbed by the target and fibers falls onto the target surface as they fluctuate in the stream, preserving their alignment in the stream. Scanning electron micrograph (bottom left) and corresponding Fourier transform (bottom right) images in FIG. 10A of fibers deposited with this deposition angle confirm the fiber alignment in the stream. If the stream hits the surface of the target at a perpendicular orientation as depicted in the top image of FIG. 10C, the air jet impinges on the target and forms a divergent decelerating flow field, the opposite of the convergent accelerating field used to form the stream. Consequently, the fiber buckles and spread into a random cloud, resulting in random deposition with little to no alignment as shown by the scanning electron micrograph (bottom left) and corresponding Fourier transform (bottom right) images in FIG. 910 of fibers deposited with this deposition angle. Using an intermediate incident angle leads to partially aligned deposition as shown in FIG. 10B. In the SEM images, scale bars are 20 μm. Various alignment patterns are possible by moving the target relative to the stream in accordance with some embodiments. For example, collecting on a rotating disk produces a fiber sheet with rotating alignment through the thickness as illustrated by FIG. 9D. Collecting on a rotating cylinder produces a helical alignment as illustrated by FIGS. 10E and 10F. In some embodiments, combinations of control of the deposition angle and target rotation may be employed to create more complex fiber alignment patterns.

In some embodiments, a rotary jet spinning system may also include a second reservoir configured to hold a second polymer material, which may be different than the first polymer material. In some embodiments, the rotary jet spinning system may also include second one or more gas flow sources configured, and the second reservoir and the second one or more gas flow sources may be configured for gas flow through the reservoir to form a gas flow downstream of the reservoir along a second direction, which may be substantially parallel to a rotation axis of the second reservoir, or may be at an angle to the rotation axis of the second reservoir. The gas flow may entrain and deflect fibers to form a second fiber stream in the second direction. In some embodiments, the first reservoir and the second reservoir are oriented such that they can both deposit fibers onto a same target surface simultaneously. All of the features and aspects described herein with respect to the reservoir 12 would also apply to a second reservoir, and all of the features and aspects described herein with respect the one or more gas flow sources would also apply to the second one or more gas flow sources.

In some embodiments, the polymer material is a polymer solution and the polymer fiber is formed by evaporation of a solvent from the polymer solution. In some embodiments, the polymer material is a polymer melt and the polymer fiber is formed at least partially by solidification due to cooling. Additional details regarding rotary spinning systems, such as reservoirs, spin speeds, orifice diameters, polymers, polymer solutions, and other polymer materials, such as polymer melts, may be found in U.S. Patent No. 2013/0312638, which is incorporated by reference herein in its entirety.

Figure 11A:
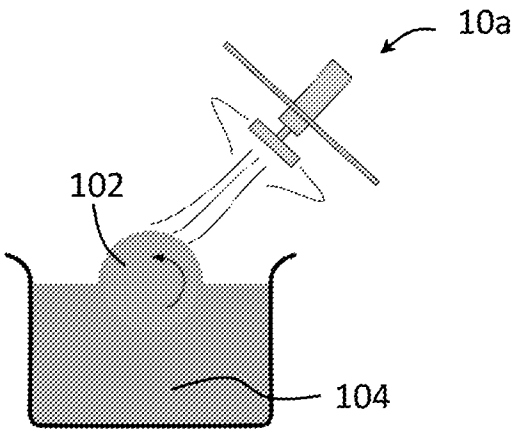
FIG. 11A schematically depicts a rotary jet spinning system for wet spinning applications including a bath for precipitation, coagulation or cross linking of the polymer material in accordance with some embodiments.

In some embodiments, a rotary jet spinning system 10*b* for stream deposition may employ a polymer material that requires cross-linking, precipitation, or coagulation for fiber formation. In some such embodiments, a rotating target 102 that that is at least partially submerged in a precipitation, coagulation, or cross-linking bath 104 may be exposed a stream of the polymer material (see FIG. 11A). Additional details regarding precipitation, coagulation, or cross-linking baths and wet rotary jet spinning systems and methods may be found in U.S. Patent Publication No. 2015/0354094, the entire content of which is incorporated herein by reference.

Figure 11B:
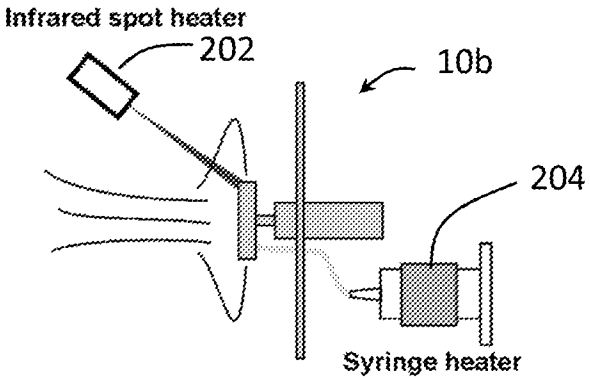
FIG. 11B schematically depicts a rotary jet spinning system for melt spinning including one or more heaters to heat the polymer material in accordance with some embodiments.

In some embodiments, the polymer material may include a polymer melt and a system 10*b* may include a heater 204 (e.g., a syringe heater) for heating the polymer material prior to delivery to the reservoir (see FIG. 11B). The system 10*b* may additionally or alternatively include a reservoir heater 204 for heating the polymer material while it is in the reservoir. As depicted in FIG. 11B, the reservoir heater may be an infrared spot heater in some embodiments.

Figure 11C:
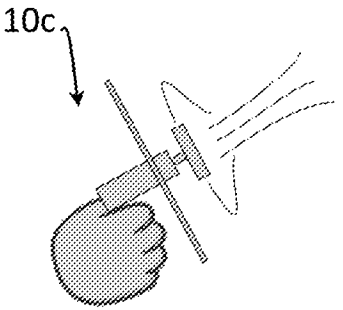
FIG. 11C schematically depicts a hand held rotary jet spinning system in accordance with some embodiments.

In some embodiments, a rotary jet spinning system for stream fiber deposition 10*c* may configured as a handheld device, as depicted in FIG. 11C.

Figure 11D:
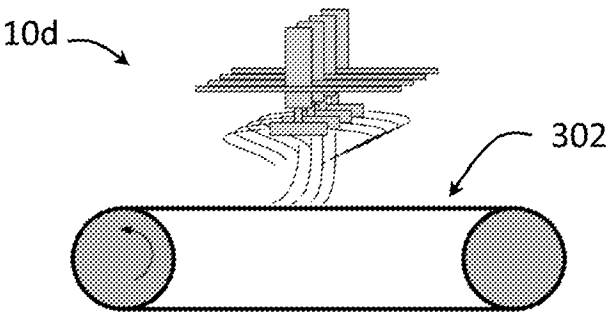
FIG. 11D schematically depicts a system including multiple rotary jet spinning systems used for stream deposition a production process in accordance with some embodiments.

In some embodiments, a system 10*d* may include multiple rotary jet spinning systems for fiber deposition, which may be depositing fibers onto a targets being linearly transported, such as on a conveyor belt 302 as shown in FIG. 11D. In some embodiments, a system or a plurality of rotary jet spinning systems may be adapted for use in a production line.

In some embodiments, the systems are configured for deposition of fibers having an average diameter of less than 10 μm. In some embodiments, the systems are configured for deposition of fibers having an average diameter of less than 5 μm. In some embodiments, the systems are configured for deposition of fibers having an average diameter of less than 3 μm. In some embodiments, the systems are configured for deposition of fibers having an average diameter of less than 2 μm.

Embodiments include methods of depositing micron or nanometer dimension fibers onto a surface of a target. Some embodiments of methods are described herein with respect to the system 10 depicted in FIGS. 3A-3G solely for illustrative purposes; however, one of ordinary skill of the art in view of the present disclosure will appreciate that other systems can be employed with methods described herein. In some embodiments, a method includes rotating a reservoir 12 having an outer sidewall 18 and at least one orifice 22 about a rotation axis 21 to eject a jet 24 of a polymer material from the at least one orifice 22 which solidifies to form a polymer fiber 15. During rotation of the reservoir 12 and ejection of the polymer material jet 24 to form the polymer fiber, at least one flow of gas, e.g., flow 30*a*, flow 30*b*, flow 30*c* or flow 30, is directed through a portion of the reservoir radially inward from the outer sidewall 18 of the reservoir 12 from an upstream end 14 of the reservoir to a downstream end 16 of the reservoir, entraining the polymer fiber 24 with the at least one flow of gas 30 and forming a focused fiber deposition stream. The focused fiber deposition stream is collected on a target surface to form the polymeric fiber material. In some embodiments, the focused fiber deposition stream flows in a first direction that is about parallel to a rotation axis of the reservoir. In some embodiments an orientation of the first direction is within 20 degrees of the rotation axis of the reservoir, within 10 degrees or within 5 degrees of the rotation axis of the reservoir. In some embodiments, the at least one flow of gas is a plurality of flows of gas 30*a*, 30*b*, 30*c* that converge and combine to form a combined gas flow 30 in the first direction (see FIG. 3F). In some embodiments, the reservoir includes at least one aperture 20*a*, 20*b*, 20*c* radially inward of the sidewall that enables the at least one flow of gas to flow through the reservoir.

In some embodiments, the fibers deposited have an average diameter of less than 10 μm. In some embodiments, the fibers deposited have an average diameter of less than 5 μm. In some embodiments, the fibers deposited have an average diameter of less than 3 μm. In some embodiments, the fibers deposited have an average diameter of less than 2 μm.

Systems and methods described herein may be employed for many different uses and purposes. For example, as a non-limiting list, systems and methods may be employed for the production of composite materials, for tissue engineering (e.g., for cell or tissue scaffolds), or for garment design. Some embodiments are particularly well suited for formation of structures having complex three-dimensional shapes and/or complex fiber alignments. The capability to control both the 3D shape and the alignment of the fiber deposition can impact various areas where structured fibrous material is involved, such as fashion design, composite materials, and tissue engineering.

Example—Engineered Heart Ventricles

A tissue scaffold for engineered heart ventricles was produced to demonstrate the capabilities of some embodiments described herein. The ventricles are two heart chambers responsible for pumping blood pumping. The ventricles are made of layers of highly aligned cardiomyocytes that wrap in a helical fashion. The helical angle rotates from 45° to −45° through the thickness of the ventricle walls. The complex helical arrangement of cardiomyocytes are supported by a fibrous extracellular matrix (ECM), which primarily consists of hierarchical collagen fibers whose diameters range from tens of nanometers to a few microns. Reconstructing this fibrous ECM is regarded as a key challenge in cardiac tissue engineering. Prior efforts to reconstruct the fibrous ECM of ventricles have included numerous effort including, tissue decellularization, random fiber deposition, and 3D printing. But these efforts are still limited by the trade-off between fine fiber, complex structure, and high-throughput.

Figure 12A:
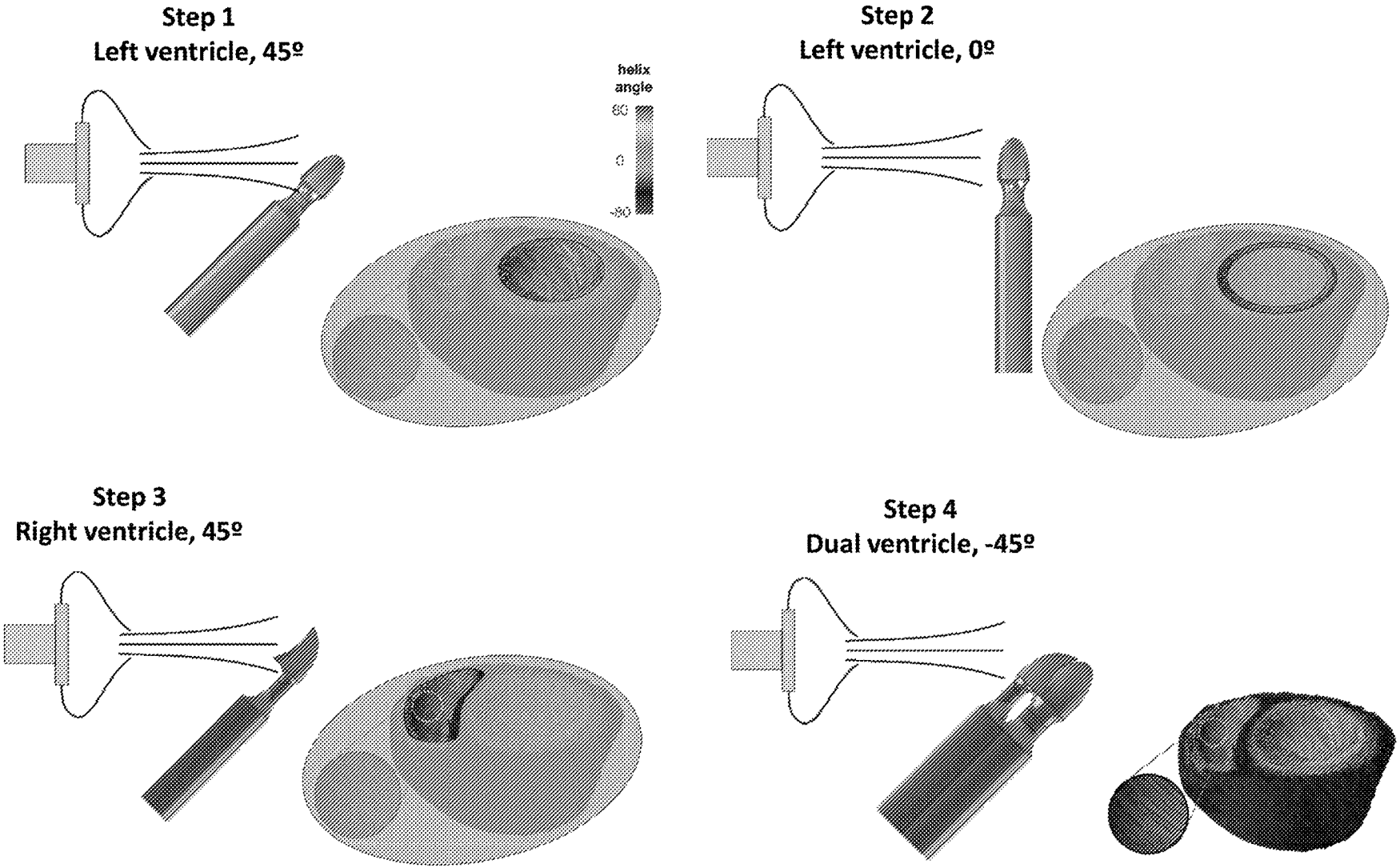
FIG. 12A schematically depicts a method of forming ventricle scaffold fiber structure in accordance with an example.

A four-step spinning procedure was employed to replicate the simplified tri-layer helical dual ventricle model as schematically depicted in FIG. 12A. The fiber diameter was selected to be a few microns, similar to the diameter of epimysial fibers in heart ECM. In step one a stream of fibers was deposited onto a rotating mandrel shaped like the left ventricle with the mandrel at an angle of 45 degrees with respect to the deposition stream. In step two, a stream of fibers was deposited onto the rotating left ventricle mandrel with the left ventricle mandrel perpendicular to the fiber stream. In step three, fibers were deposited onto a rotating mandrel shaped like the right ventricle with the right ventricle mandrel at an angle of 45 degrees with respect to the deposition stream. In step 4, the left ventricle mandrel and the right ventricle mandrel were positioned together to form a combined mandrel and fibers were deposited over the rotating combined mandrel and over the previously deposited layers of fibers at an angle of −45 degrees to the fiber stream.

The realization of these design features was verified by direct measurement and by with micro-CT imaging. FIG. 12B is an image of the combined mandrel with the previously deposited fiber layers and FIG. 12C is an image of the combined mandrel after deposition of the layer of fibers at an angle of −45 degrees to the fiber stream.

Figure 12C:
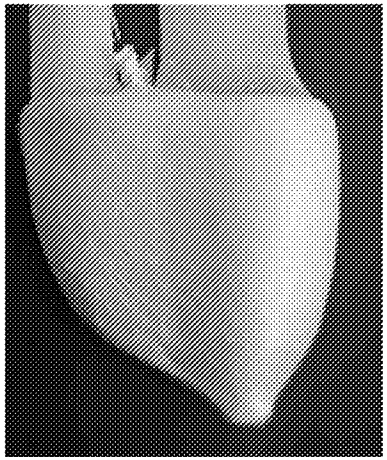
FIG. 12C is an image of the combined mandrel after deposition on the combined mandrel for form a resulting ventricle fiber scaffold structure.
Figure 12B:
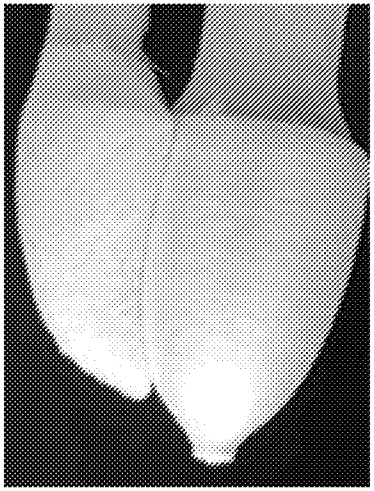
FIG. 12B is an image of a combined mandrel before deposition on the combined mandrel in accordance with an example.
Figure 12D:
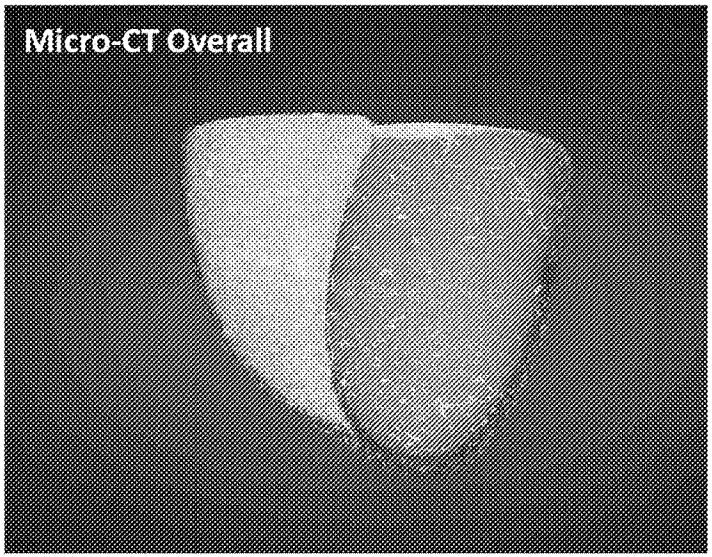
FIG. 12D is section of a micro-CT image of the resulting ventricle structure in accordance with an example.
Figure 12E:
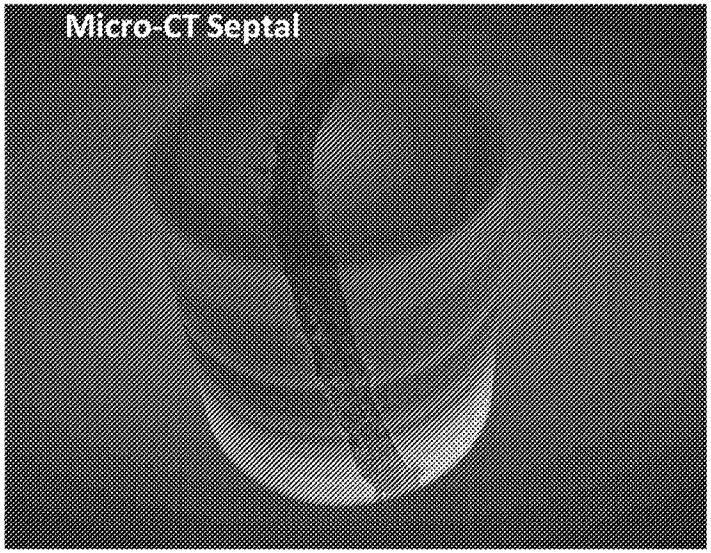
FIG. 12E is a micro-CT image of the septum of the resulting ventricle structure in accordance with an example.
Figure 12F:
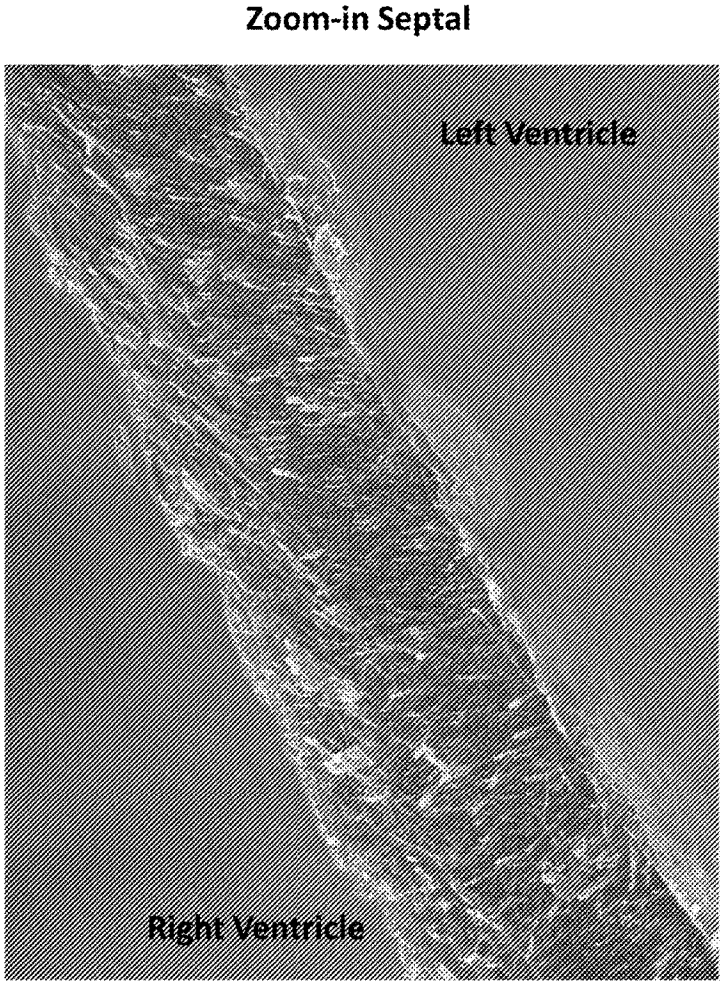
FIG. 12F is a detail micro-CT image of the septum of the resulting ventricle structure in accordance with an embodiment.

FIG. 12C is a micro CT image of a section of the resulting deposited fiber structure. FIG. 12D is a micro CT image of the septal region between the two ventricles showing the varying helical angles. FIG. 12E is a detail of the image of the septal region also showing the varying helical angles.

Approximating language, as used herein throughout the specification and claims, may be applied to modify any quantitative or qualitative representation that could permissibly vary without resulting in a change in the basic function to which it is related. Accordingly, a value modified by a term such as "about" or numerical ranges is not to be limited to a specified precise value, and may include values that differ from the specified value. In at least some instances, the approximating language may correspond to the precision of an instrument for measuring the value.

While the disclosure has been described in detail in connection with only a limited number of aspects and embodiments, it should be understood that the disclosure is not limited to such aspects. Rather, the disclosure can be modified to incorporate any number of variations, alterations, substitutions, or equivalent arrangements not heretofore described, but which are commensurate with the scope of the claims. Additionally, while various embodiments of the disclosure have been described, it is to be understood that aspects of the disclosure may include only some of the described embodiments. Accordingly, the disclosure is not to be seen as limited by the foregoing description, but is only limited by the scope of the appended claims.

We claim:

1. A system for focused directional deposition of one or more micron or nanometer dimension polymeric fibers, the system comprising:

a reservoir configured to hold a material including a polymer and rotatable about a rotation axis, the reservoir including:

a first end;

a second end opposite the first end;

an outer sidewall extending from the first end to the second end, a shape of the reservoir including one or more apertures disposed radially inward from the outer sidewall of the reservoir that are configured to enable a gas to move through the reservoir from the first end to the second end; and one or more orifices formed in the outer sidewall, each of the one or more orifices configured for ejection of the material radially outward through the orifice as an ejected jet during rotation of the reservoir; and one or more gas flow sources, each configured to direct a flow of gas from upstream of the first end of the reservoir through the one or more apertures of the reservoir from the first end to the second end of the reservoir and downstream of the second end of the reservoir during rotation of the reservoir, the one or more gas flow sources collectively forming a combined gas flow in a first direction downstream of the second end of the reservoir that entrains and deflects the one or more ejected jets to form a focused stream of the one or more micron or nanometer dimension polymeric fibers in a first direction, the first direction having an orientation that is within 5 degrees of the rotation axis of the reservoir.

2. The system of claim 1, wherein the one or more gas flow sources comprise a plurality of gas flow sources having a converging orientation to form the combined gas flow in the first direction.

3. The system of claim 1, wherein a total gas flow rate from the one or more gas flow sources is controllable to change a distance from the reservoir at which the stream of the micron or nanometer dimension polymeric fiber has the tightest focus.

4. The system of claim 2, wherein the plurality of gas flow sources comprises three gas flow sources.

5. The system of claim 1, wherein the first direction is within 2 degrees of the axis of rotation.

6. The system of claim 1, wherein the first direction is substantially parallel to the axis of rotation.

7. The system of claim 1, wherein the focused stream of the one or more micron or nanometer dimension polymeric fiber has a stream width smaller than a diameter of the outer sidewall of the reservoir.

8. The system of claim 1, further comprising a flow blocking structure disposed upstream of the plurality of gas flow sources and configured to reduce an effect of airflow upstream of the plurality of gas flow sources on focusing of the stream of the micron or nanometer dimension polymeric fiber.

9. The system of claim 8, wherein the flow blocking structure is stationary and does not rotate with the reservoir.

10. The system of claim 1, wherein the one or more gas flow sources are configured to enable control of a rate of flow of the gas to focus a lateral area of deposition of the micron or nanometer dimension polymeric fiber as the fiber travels toward a target.

11. The system of claim 1, further comprising a target rotation system configured to rotate a three dimensional target during deposition to deposit the fiber on more than one side of the target.

12. A method for formation and deposition of at least one micron or nanometer dimension polymeric fiber, the method comprising:

rotating a reservoir holding a material comprising a polymer about a rotation axis to eject at least one jet of material from at least one orifice defined by an outer sidewall of the reservoir;

directing at least one flow of gas through a portion of the reservoir radially inward of the outer sidewall, the at least one flow of gas directed from an upstream first end of the reservoir to a downstream second end of the reservoir during rotation of the reservoir and ejection of the at least one jet of the material to form at least one micron or nanometer dimension polymeric fiber, the at least one flow of gas entraining the at least one micron or nanometer dimension polymeric fiber and forming a focused fiber deposition stream of the at least one micron or nanometer dimension polymeric fiber in a first direction, the first direction having an orientation of within 5 degrees of the rotation axis of the reservoir; and collecting the focused fiber deposition stream on a target surface.

13. The method of claim 12, wherein the first direction is substantially parallel to the rotation axis of the reservoir.

14. The method of claim 12, wherein the at least one flow of gas comprises a plurality of flows of gas that converge and form a combined gas flow in the first direction.

15. The method of claim 12, wherein the focused fiber deposition stream has a substantially tangential orientation to the target surface during fiber collection.

16. A method of forming a three dimensional tissue scaffold comprising performing the method of claim 12, where the target surface is a three dimensional shape for a tissue scaffold.

17. The method for forming the three dimensional tissue scaffold of claim 16, further comprising rotating the target for deposition on more than one side of the three dimensional shape.

18. The method of claim 12, further comprising at least partially blocking flow of gas from upstream of the reservoir to reduce an effect of airflow upstream of the plurality of gas flow sources on focusing of the fiber deposition stream of the at least one micron or nanometer dimension polymeric fiber.

19. The method of claim 12, wherein the target surface is moved linearly during deposition of the fiber.

* * * * *